US006412909B1

(12) United States Patent
Tayuki et al.

(10) Patent No.: US 6,412,909 B1
(45) Date of Patent: Jul. 2, 2002

(54) PRINTING DEVICE

(75) Inventors: Kazushige Tayuki; Yukimitsu Fujimori; Koichi Otsuki, all of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/626,907

(22) Filed: Jul. 27, 2000

(30) Foreign Application Priority Data

Jul. 30, 1999 (JP) ..... 11-216700

(51) Int. Cl.[7] ..... B41J 2/15
(52) U.S. Cl. ..... 347/41; 347/15; 347/16
(58) Field of Search ..... 347/41, 40, 12, 347/15, 43, 16, 14, 9

(56) References Cited

U.S. PATENT DOCUMENTS

| | | | | |
|---|---|---|---|---|
| 4,198,642 A | | 4/1980 | Gamblin | 346/75 |
| 5,844,585 A | * | 12/1998 | Kurashima et al. | 347/43 |
| 6,149,264 A | * | 11/2000 | Hirabayashi et al. | 347/43 |
| 6,164,756 A | * | 12/2000 | Takahashi et al. | 347/43 |
| 6,170,932 B1 | * | 1/2001 | Kanaya et al. | 347/41 |

FOREIGN PATENT DOCUMENTS

| | | | |
|---|---|---|---|
| EP | 0 667 242 A | 8/1995 | B41J/19/14 |
| EP | 0 916 494 A | 5/1999 | B41J/2/05 |
| EP | 0 925 921 A | 6/1999 | B41J/2/01 |
| JP | 7-251513 | 10/1995 | B41J/2/21 |
| JP | 10-278247 | 10/1998 | B41J/2/01 |

* cited by examiner

*Primary Examiner*—Lamson D. Nguyen
(74) *Attorney, Agent, or Firm*—Sughrue Mion, PLLC

(57) ABSTRACT

The invention comprises a printing device wherein a head comprising a plurality of nozzles at a predetermined pitch is used for repeated primary scanning and sub-scanning to print images. The primary and sub-scanning are carried out in such a way as to comply with the following conditions. In the case of printing at a high resolution, dots are first formed during bi-directional operation of the primary scan. Second, the direction in which the dots are formed is aligned for each raster line. Third, a plurality of raster lines formed during operation in the same direction are adjacent to each other. Dots are formed under such conditions to allow the direction in which the dots are formed to be locally aligned. That is, locations with easily discernible shifts in the dots formed during forward travel and the dots formed during return travel can be reduced, allowing the grainy look of images to be improved.

23 Claims, 13 Drawing Sheets

| | Feed | ODD | EVEN |
|---|---|---|---|
| TEXT PRINT MODE | 3, 4 | FORWARD TRAVEL | RETURN TRAVEL |
| NATURAL IMAGE PRINT MODE | 2, 3, 4, 4, 9, 2 | 1st PRIMARY SCAN | 2nd PRIMARY SCAN |

Fig. 11
| | Feed |
|---|---|
| 360×720DPI | 47 |
| 720×720DPI | 22, 25, 22, 23 |
| 1440×720DPI | 10, 13, 10, 11 |
Fig. 12
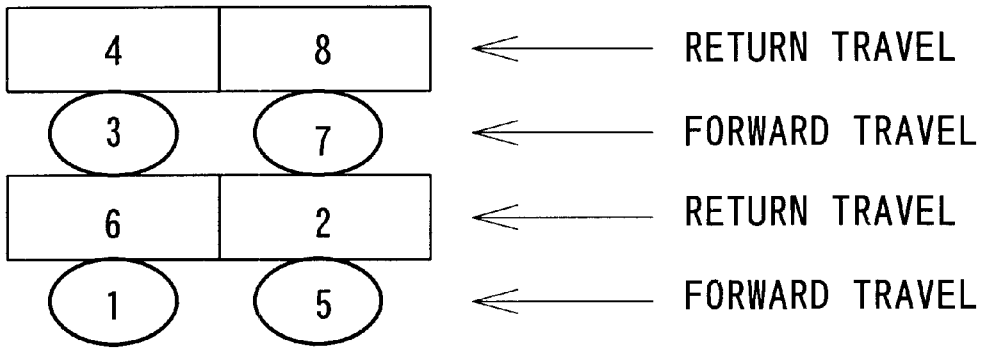
Fig. 13
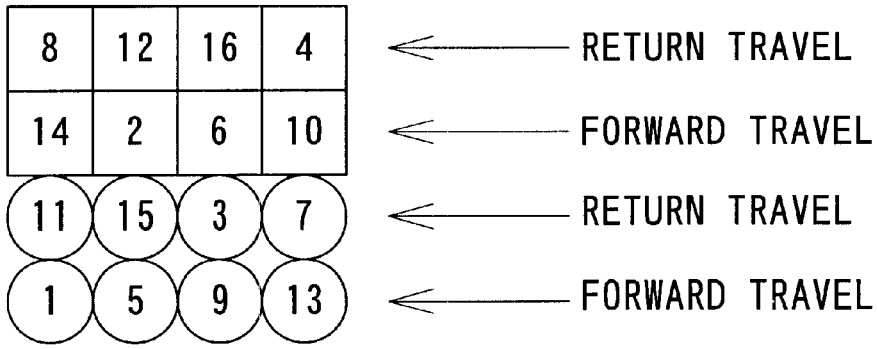

PRINTING DEVICE

BACKGROUND OF THE INVENTION

1. Field of the Invention

The present invention relates to a printing device and method for forming dots during the movement of a head as it travels back and forth to print multi-colored multi-tone images on a printing medium, and to a recording medium on which is recorded a program for such printing.

2. Description of the Related Art

Various printers have been used in the past as computer or digital camera output devices. Such printers include ink jet printers that jet ink to form dots and print multi-colored multi-tone images. In ink jet printers, dots are formed for each pixel by repeated primary scanning, in which the head travels back and forth, and sub-scanning, in which the printing paper is conveyed. Dots are formed by ink of predetermined colors, and multiple colors are brought out by the overlapping of these inks. The tones of images are brought out by the dot recording density.

Ink jet printers commonly make use of multinozzles comprising a plurality of nozzles arranged at a constant pitch in the sub-scanning direction for each color in order to enhance printing speed. In such cases, differences in the ink discharge properties of each nozzle can cause shifts in the positions where the dots are formed. Feed errors during sub-scanning can also cause shifts in the positions where the dots are formed. Such shifts can cause irregularities in density, referred to as banding, which can result in a loss of image quality. Printing based on what is referred to as interlacing or overlapping formats has been proposed in an effort to suppress such loss of image quality due to banding.

Interlacing refers to a format for printing images as raster lines are intermittently formed in the sub-scanning direction. FIG. 20 illustrates an example of the interlacing format. This is a case involving the use of 3 nozzles arranged at a nozzle pitch k of 2 dots. In FIG. 20, the circles containing 2 digits indicate the dot recording positions. The left numeral of the two-digit numbers indicates the nozzle number, and the right number indicates the primary scan during which the dot is printed.

The dots of each raster line are formed by the 2nd and 3rd nozzles in the first primary scan in the interlaced format recording illustrated in FIG. 20. The first nozzle does not form dots. After paper feed L equal to three raster lines, each raster line is formed using the first through third nozzles in the second primary scan. Images are subsequently printed by similarly repeating paper feed equal to three raster lines, and raster line formation by primary scanning. No raster lines are formed by the first nozzle in the first primary scan because no adjacent raster lines can be formed by second and subsequent primary scanning under the raster lines.

The overlapping format refers to the formation of raster lines with two or more nozzles by intermittently forming dots on the raster lines in each primary scan. For example, in the first primary scan, odd-numbered pixels of a given raster line are formed with one nozzle, and in the second primary scan, the even-numbered pixels are formed by another nozzle. Raster lines can also be formed by 3 or more scans, of course.

Shifts in the dot formation position due to sub-scan feed errors or ink discharge properties during interlacing or overlapping format printing can be dispersed in the sub-scanning direction or primary scanning direction. Shifts in the dot forming position can thus be rendered negligible, banding can be suppressed, and image quality can be improved.

Better image quality as well as faster printing are also generally important in improving printer convenience. A technique for forming dots during the movement back and forth in primary scanning has been proposed in order to improve printing speed in ink jet printers (such printing is henceforth referred to as bi-directional printing). A combination of the interlaced or overlapping formats of printing with bi-directional printing enables faster printing with better image quality in ink jet printers.

In bi-directional printing, however, the positions where the dots are formed can sometimes shift in the primary scanning direction for various reasons, such as backlash in the mechanisms moving the head back and forth or errors in the head position detection. There is a need to set the primary scanning direction for forming pixels by taking into account the effects of such shifting on image quality in order to obtain good image quality during bi-directional printing.

The printing device in JAPANEZE PATENT LAID-OPEN GAZETTE No. 7-251513 is an example of the study of such matters. This printing device involves the use of a head including a plurality of nozzles at a pitch of 2 dots in the sub-scanning direction. An example of bi-directional printing employing the overlapping format to form raster lines with two nozzles has also been disclosed as an enhanced printing mode. According to this disclosure, good text quality is achieved in the first mode, where the even-numbered pixels of the raster lines are formed during forward travel in primary scanning, and the odd-numbered pixels are formed during return travel of primary scanning. Good image quality with solid ink and no drop out is achieved in the second mode, where the even-numbered raster lines are formed during forward travel in primary scanning, and the odd-numbered raster lines are formed during return travel in primary scanning.

However, this is only an extremely limited study, the object of which is merely a head with nozzles arranged at a pitch of 2 dots. A head with nozzles arranged at a pitch of 2 dots affords only three modes—the above two described modes and another mode in which pixels formed during movement in the same direction are disposed in a checkered pattern. The above document studies the relation of image quality in two out of the three modes.

The resolution of ink jet printers has been developed to an extremely high degree in recent years, with a trend toward the use of finer dots. Because of manufacturing limitations, the head nozzle pitch is often greater than 2 dots. A head nozzle pitch greater than 2 dots is also desirable to open up the interval in the sub-scanning direction of the dots formed in one primary scan and to prevent the dots from smearing. The correlation between the pixels and the direction in primary scanning is more diverse with the use of heads in which the nozzles are arranged at a pitch greater than 2 dots.

In such cases, there are no conventional examples studying whether pixels should be formed during forward or return travel to improve image quality. In other words, there is room for further improvement in image quality in conventional printer devices by improving the correlation between the direction of movement during the formation of the pixels.

SUMMARY OF THE INVENTION

An object of the present invention is to improve image quality in bi-directional printing, and also to provide a technique for faster and higher resolution printing.

A printing device of the present invention prints multi-colored images by means of primary scanning and sub-scanning so as to form dots for pixels on a printing medium. During the primary scanning, a head travels back and forth relative to the printing medium to form raster lines. During the sub-scanning, the printing medium is conveyed relative to the head in the direction across to the primary scanning direction. The head includes, in the sub-scanning direction, at intervals of two or more raster lines per color, a plurality of nozzles for discharging ink. And the printing device includes: memory for storing control parameters, including the position of the pixels that are to be formed during each primary scan and the feed of the sub-scan; head drive controller for driving the head while moving back and forth in the primary scanning to form dots for the pixels specified by the control parameters; and sub-scanning mechanism for effecting sub-scanning at a feed specified by the control parameters. The parameters are set in compliance with conditions allowing the direction of the primary scan during the recording of dots with each ink to be locally aligned in both the primary scanning direction and sub-scanning direction within a predetermined multi-tone range.

In such a printing device allows the direction of primary scanning during the printing of dots by each ink within a predetermined multi-tone range to be locally aligned in both the primary and sub-scanning directions (henceforth referred to simply as "dot forming direction"). No shift in the dot forming positions is produced during bi-directional printing in areas where the direction of primary scanning has thus been locally aligned. The printing device suppresses location deviations in regions where images are printed within a predetermined multi-tone range, suppresses roughness of images, and allows smoother printing. Although various specified multi-tone ranges can be set, the preferred range includes intermediate tones with which irregularities in density are less distinguishable. The predetermined multi-tone range is not necessarily set within a continuous range. A low multi-tone and high multi-tone may be set within the predetermined multi-tone range.

Here, intermediate tone refers to a multi-tone within the multi-tone range which can be reproduced by the printer device. Strictly speaking, it does not mean intermediate values. In a bright multi-tone range, that is, in low multi-tone regions, the dot recording density is lower. Shifts in the dot forming positions are thus less distinguishable and have relatively little effect on image quality. Conversely, in a dark multi-tone range, that is, in higher multi-tone regions, the dot recording density is extremely high. Slight shifts in the dot forming positions are thus difficult to distinguish in the form of irregularities in density and the like, and have relatively little effect on image quality. Intermediate tones thus mean the exclusion of such low and high multi-tones, and mean any multi-tone range which has been set for the purpose of improving image quality. In particular, it is possible to target a multi-tone range in which image quality is significantly affected by shifts produced in bi-directional printing within such a multi-tone range. It is also possible to target a multi-tone range frequently used for commonly printed images.

Gray scale ranges in which image quality is significantly affected cannot be strictly defined as a matter of absolute principle, and vary according to the conditions prevailing during printing, such as the printing resolution or dot diameter. In fact, they may be defined as a multi-tone range in which image roughness is easily discerned when images are printed with various changes in the primary scanning and sub-scanning.

The conditions under which the dot forming direction is locally aligned are described using a specific example. FIG. 8 illustrates a plurality of adjacent raster lines formed in the same direction. An eight-raster line segment is depicted here. As illustrated in this figure, the dots of each raster line are formed aligned either during forward or return travel of primary scanning. From the top, raster lines formed during forward travel in primary scanning alternate in groups of 3 with those formed during return travel. As a result, more than 2 dots formed during forward travel near D1 in the figure, including dot D1, are present in the primary and sub-scanning directions. The direction in which all the dots in FIG. 8 are similarly formed is locally aligned in the primary and sub-scanning directions. When shifts in the dot forming positions occur during forward and return travel in such cases, shifts in the dot forming positions can be discerned in the two locations designated G1 and G2, as shown in the figure.

FIG. 9 illustrates adjacent raster lines formed in different directions. An eight-raster line segment is depicted here as in FIG. 8. A look at the dots in D1' shows that the dot forming direction is aligned in the primary scanning direction. However, dots formed in different directions are adjacent to each other in the sub-scanning direction, and the direction in which they have been formed cannot be considered to be locally aligned. This is true not only of dot D1', but all the neighboring dots. In such cases, as shown in the figure, shifts in the dot forming position in the primary scanning direction are discernible in a total of 7 locations comprising g1, g2, g3, etc.

Comparison of FIGS. 8 and 9 clearly shows that the local alignment of the dot forming direction would reduce the locations in which shifts in the dot forming direction can be discerned. In cases of adjacent raster lines in the same direction (FIG. 8), the area of regions G1 and G2 where shifts have occurred is greater than the surface area of regions g1 and g2 in FIG. 9. The effect of such differences in surface area on image quality is relatively low, however, in the relatively high resolution printing executed by recent printing devices. By contrast, as shown in FIG. 9, when shifts occur in several locations, the overall image quality becomes grainy, resulting in rougher printed images as a whole. Accordingly, reducing the number of regions where shifts occur can improve the grainy look of images and provide better image quality.

The above examples were of groups of 3 adjacent raster lines formed in the same direction, but there are fewer locations in which shifts can be discerned depending on the number of adjacent raster lines, allowing image quality to be improved. These were also examples in which the dot forming direction was aligned for each raster line, but the direction of formation of all the raster lines does not have to be aligned, as long as the condition stipulating the local alignment of the direction in which adjacent dots are formed is met. For example, the dot forming direction for the raster lines may vary every two raster lines. That is, in the example depicted in FIG. 8, dots D1 and D2 may be formed during forward travel, dots D3 and D4 may be formed during return travel, and dot D5 may be formed during forward travel again.

Conditions stipulating the local alignment of the direction in which adjacent dots are formed can be satisfied in various ways according to the dot printing rate in intermediate tones. FIG. 8 shows an example in which the direction of formation is locally aligned in a case involving a high printing rate of close to 100%. This printing method allows the direction of formation to be locally aligned at a high printing rate of more than 50%. In this case, there is a high possibility that the dots will be formed for adjacent pixels in the primary or sub-scanning direction. Printing in the manner depicted in FIG. 8 therefore allows the direction in which adjacent dots are formed to be locally aligned.

The dot printing rate in intermediate tones will vary according to the conditions during printing. For example, when printing is performed using large-diameter dots, intermediate tones are developed at a low printing rate. FIG. 15 illustrates a plurality of adjacent raster lines formed in the same direction at a low printing rate. In this case, adjacent dots are not necessarily limited to being formed for adjacent pixels in the primary and sub-scanning directions. Here, dots are formed 1 pixel at a time in each direction. When printing is done in the same manner depicted earlier in FIG. 8 at this printing rate, the raster line r1 is formed in a different direction than the direction in which the adjacent raster lines above and below are formed, as shown in FIG. 15. In other words, the direction in which the adjacent dots around raster line r1 are formed is not locally aligned.

FIG. 16, meanwhile, illustrates adjacent raster lines formed in different directions at a low printing rate. When printing is done in the same manner depicted earlier in FIG. 9 at this printing rate, the direction in which the adjacent dots are formed is aligned, as shown in FIG. 16. Thus, in the case of a low printing rate, image quality can be improved by alternating the direction in which the raster lines are formed. Of course, this does not mean that the raster lines formed in different directions in the above examples must be adjacent in an alternating manner. The control parameter stipulating the local alignment of the direction in which adjacent dots are formed can be set in a variety of ways according to the printing rate of the dots representing intermediate tones.

FIGS. 15 and 16 illustrate cases of systematically dispersed dots. In actuality, it is possible that the dots will not be systematically formed at such a printing rate, and that the dots will be formed for adjacent pixels in the primary or sub-scanning direction. Such locations are relatively few, however, and the dots are formed as depicted in FIGS. 15 and 16 when viewed locally. The present invention is intended to provide effects in suppressing roughness by suppressing shifts in the dot forming positions. Accordingly, the conditions under which the dot forming direction is locally aligned do not have to be strictly observed for all image regions, but should be observed for the most part.

The printing device can provide the effects described above, and can also suppress banding because a head having nozzles at intervals of two or more raster lines is used for interlaced format printing. Based on the actions described above, the printing device allows the direction in which the dots are formed to be locally aligned during high speed printing based on bi-directional printing, thereby enabling high image quality printing with less image roughness.

As noted above, the printing device does not necessarily require alignment of dot formation for each raster line, but the control parameters are preferably set in compliance with conditions under which the direction of primary scanning during the formation of dots is aligned during either forward or return travel for each raster line.

When done in this manner, the dot forming direction is aligned for each raster line, thus ensuring that the dot forming direction is aligned in the primary scanning direction. When shifts in the dot forming position occur while dots formed during forward travel and dots formed during return travel are present together in the raster lines, the dot density is quite easily discerned, tending to result in a loss of image quality.

The control parameters of the printing device are also preferably set in compliance with conditions under which the raster lines are formed by a plurality of primary scans. This allows overlapping format printing to be done, wherein the raster lines are formed by a plurality of primary scans. It is thus possible to disperse the shifts in dot forming positions caused by the ink discharge properties and the like, and to reduce banding. It is thus possible to realize printing with even higher image quality.

As noted previously, the control parameters stipulating local alignment of the direction in which the dots are formed vary according to the printing conditions. The memory thus preferably further storing the control parameters according to the resolution.

When the printing resolution is changed, the diameter of the dots being used is primarily changed, and the dot printing rate in intermediate tones is changed. Thus, as described in the comparison between FIGS. 8 and 9 and FIGS. 15 and 16, the control parameters for performing suitable printing also change. A printing device having the structure allows printing to be carried out with the use of separate control parameters according to resolution, and thus allows high image quality printing to be realized for each resolution. When the resolution is changed, there may also be some changes in multi-tone ranges which are susceptible to readily discernible roughness. In the printing device, the predetermined multi-tone range serving as the basis for setting the control parameters does not necessarily require alignment for each resolution, and may be suitably selected for various resolution levels.

The printing device also preferably includes printing mode setting unit for determining whether or not text images are to be printed; and printing controller for controlling the head drive controller and the sub-scanning mechanism to execute printing based on control parameters only when the text image printing mode has been set.

Such a printing device allows printing to be carried out with control parameters that are different depending on whether or not text images are being printed. Printing based on the control parameters indicated earlier can improve grainy images and can dramatically improve image quality in cases where dots are formed throughout virtually the entire image, such as natural images. That is, this embodiment is suitable for cases in which a non-text image printing mode is set. The printing device enables printing based on the control parameters given above in this mode.

In the printing device, the memory storing text printing control parameters, including the position of the pixels that are to be formed during each primary scan, and the feed of the sub-scan set in compliance with conditions allowing the raster lines to be formed by a plurality of primary scans, and conditions allowing the direction of the primary scan forming the pixels to be aligned during either the forward or return travel for each position in the direction; and the printing controller can execute printing based on text printing control parameters instead of the above control parameters when the text image printing mode has been set.

This allows the image quality of text images to be improved. When printing is based on text printing control parameters, the direction of movement for forming pixels matching the primary scanning direction position is aligned. As a result, it is possible to more accurately represent a variety of straight lines, particularly straight lines in the sub-scanning direction. Text images include an abundance of straight lines. The printing device allows straight lines to be more accurately represented, and can thus improve the image quality of text images. Text images refer images containing text, as well as images containing an abundance of linear and other geometrical patterns, such as graphs.

The memory can store the control parameters according to the type of printing medium.

When the printing medium is changed, the diameter of the dots being used is primarily changed, and the dot printing rate in intermediate tones is changed. Thus, the control parameters for performing suitable printing also change in accordance therewith. Different types of printing media are often designed for a particular intended use. That is, the types of images to be printed are often primarily established for each printing medium. As noted above, the dot formation format for suitable printing varies depending on the type of image. The printing device allows suitable printing to be realized with the use of separate control parameters according to the printing medium by taking such differences into account.

In the printing device, the head should include nozzles arranged in the sub-scanning direction at a predetermined interval of 3 dots or more. Such a head allows a plurality of raster lines formed in the same direction to be adjacent to each other, without significant decreases in the nozzle operating efficiency. Of course, the printing device can be adapted for printing devices equipped with heads comprising a variety of nozzle pitches and number of nozzles, and may also involve the use of heads in which the nozzles are arranged at a pitch of 2 dots, while portions of the nozzle are masked so as to comply with the above conditions.

Increasingly higher resolution levels have been reached in recent printing devices. There is also a general need for printing with higher image quality during such high resolution printing. When greater image quality is to be achieved during such high resolution printing, the printing device includes a printer device for printing multi-colored images by means of primary scanning, in which a head travels back and forth relative to a printing medium to form raster lines comprising rows of dots in the direction, and sub-scanning, in which the printing medium is conveyed relative to the head in the direction perpendicular to the primary scanning direction, so as to form dots for the pixels on the printing medium, the head being a head comprising, in the sub-scanning direction, at intervals of two or more raster lines per color, a plurality of nozzles for discharging ink, wherein the printing device includes: memory for storing control parameters, including the position of the pixels that are to be formed during each primary scan, and the feed of the sub-scan; head drive controller for driving the head while moving back and forth in the primary scanning to form dots for the pixels specified by the control parameters; and sub-scanning mechanism for effecting sub-scanning at a feed specified by the control parameters. The parameters are set in compliance with conditions allowing the direction of the primary scan during the formation of dots to be aligned during either the forward or return travel for each raster line, and conditions under which two or more raster lines formed in each direction of primary scanning are adjacent to each other.

During high resolution printing, there is a high probability of the dots being formed for adjacent pixels in the primary and sub-scanning directions. Printing based on control parameters set under the conditions thus allows the direction in which dots are formed to be locally aligned, and allows higher image quality printing to be achieved with less image roughness.

Printing devices for high resolution printing commonly include a printing mode for rapid, low resolution printing.

The printing device thus preferably further includes resolution setting unit for setting the resolution during printing as a printing condition; and printing controller for controlling the head drive controller and the sub-scanning mechanism to execute printing based on the control parameters when the resolution is no less than a predetermined level.

This allows high image quality printing to be achieved during high resolution printing.

In this case, low resolution printing can be managed in various ways.

The memory should furthermore stores second control parameters, including the position of the pixels that are to be formed during each primary scan, and the feed of the sub-scan; and the printing controller executing printing based on the second control parameters when the resolution is below the predetermined level. The second parameters are set in compliance with conditions under which the raster lines are formed by a plurality of primary scans, conditions allowing the dot forming direction to be aligned during either the forward or return travel for each raster line, and conditions under which raster lines formed during movement in different directions are adjacent to each other.

When high resolution and low resolution printing modes are set within a practical range in printer devices, intermediate tones are often represented at a printing rate of around 25% in low resolution mode. This corresponds to the printing rates in FIGS. 15 and 16 described previously. The printing device thus allows the direction in which adjacent dots are formed to be locally aligned even at low resolution levels, and allows image roughness to be suppressed.

The predetermined level of resolution serving as a basis for changing the particulars of control by the printing controller can be preset in a variety of ways based on the relation between resolution and roughness. The predetermined level can be preset as a constant level, and when the resolution setting unit allows the resolution in the primary scanning direction and the resolution in the sub-scanning direction to be set to different levels, the printing controller may adapt the resolution in the sub-scanning direction to the predetermined level and effect the control according to the relationship of the magnitude between the resolution in the primary scanning direction and the predetermined level.

Here, the resolution in the primary scanning direction and the resolution in the sub-scanning direction is not necessarily to set both to any combination. Based on the predetermined correlation, there are also cases capable of different level settings. For example, "the resolution in the primary scanning direction ( the resolution in the sub-scanning direction" can be set to a predetermined combination such as "360 dpi (720 dpi, " "720 dpi (720 dpi," and "1440 dpi ( 720 dpi," so that the resolution levels are set by selecting from these.

The present invention can also further include printer devices in the following embodiments.

That is, a printing device includes: memory for storing control parameters, including the position of the pixels that are to be formed during each primary scan, and the feed of the sub-scan; printing condition inputter for inputting printing conditions; head drive controller for driving the head while moving back and forth in the primary scanning to form dots for the pixels specified by control parameters according to the printing conditions; and sub-scanning mechanism for effecting sub-scanning at a feed specified by the control parameters according to the printing conditions. The parameters are set so that the dots formed in the same primary scanning direction are formed adjacent to each other according to the printing conditions.

In this printing device, the printing conditions can include the resolution during printing, and the control parameters are at least set so that the number of dots formed in the same primary scanning direction, which are adjacent to each other in the sub-scanning direction, is a value corresponding to the resolution.

The printing conditions can also include the type of images, and the control parameters can be at least set so that dots formed in the same primary scanning direction are aligned with pixels of the same position in the primary scanning direction, for text images.

The printing conditions can also include types of printing media.

In this case, printing media primarily used for printing text images, for example, are printed in the same manner as text images, and printing media primarily used for natural image printing are printed while conditions are set so that a plurality of dots formed by primary scanning in the same direction are adjacent to each other in the sub-scanning direction. The printing mode for each printing medium may be set in consideration of the diameter of the dots that are formed, irrespective of the intended use of the printing medium.

The printing device of the present invention can be adapted for heads discharging ink in a variety of ways. Methods that can be adapted include, for example, the use of electrostrictive elements such as piezo elements to alter the ink channel in the nozzle and discharging ink with the application of pressure. Another method that can be adapted is to apply electricity to a heater inside the ink channel to produce gas bubbles in the ink, so as to make use of the pressure of the gas bubbles to discharge the ink.

The present invention can be constructed as a printing method in addition to the structure of the printing devices. The method can be realized in a variety of ways, such as a computer program for executing the printing method or printing device, recording media on which such a program is recorded, and data embodied in carrier waves, including such programs. It also goes without saying that various added elements indicated in the printing devices above can be adapted in various ways.

When the present invention includes a computer program, or recording media on which such a program is stored, or the like, the invention may include the entire program for operating the printing device or only those portions enacting the functions of the present invention. Examples of recording media which can be used include floppy discs, CD-ROM, opticomagnetic discs, IC cards, ROM cartridges, punching cards, bar codes, and other printed materials with codes printed thereon, and various media which can be read by computers such as internal memory devices of computers (memory such as RAM or ROM) and external memory devices.

BRIEF DESCRIPTION OF THE DRAWINGS

FIG. 11 illustrates an example of a control parameter table in Example 2.

FIG. 12 illustrates the appearance of dots formed at low resolution.

FIG. 13 illustrates the appearance of dots formed at intermediate resolution.

DESCRIPTION OF THE PREFERRED EMBODIMENT

Embodiments of the present invention are described below with reference to working examples.

(1) Device Structure

Figure 1:
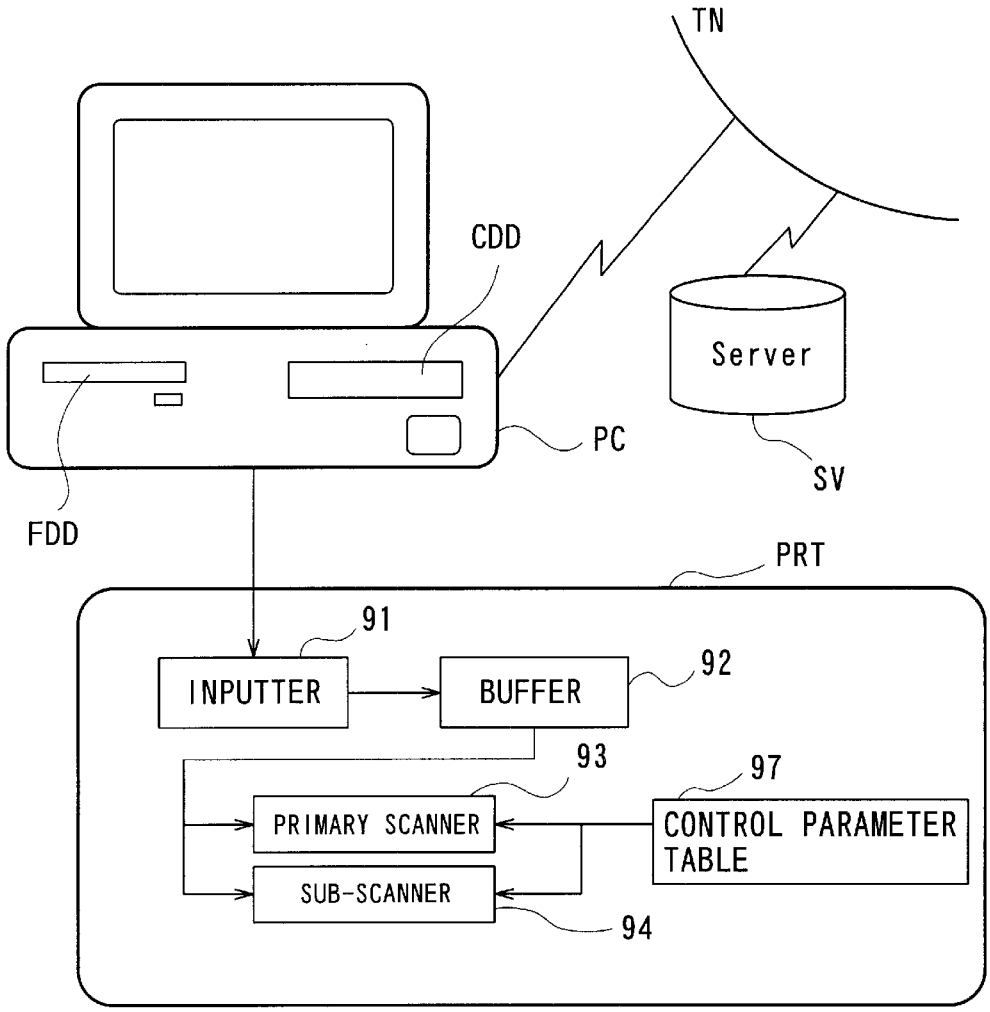
FIG. 1 illustrates the structure of the printing system featuring the use of a printer PRT as an example of the present invention.

Embodiments of the present invent ion are described below with reference to working examples. FIG. 1 illustrates the structure of a printing system featuring the use of a printer PRT as an example of the present invention. The printer PRT is connected to a computer PC, and printing is performed upon the receipt of printing data from the computer PC. The printer PRT is operated when the computer PC runs software referred to as the printer driver. The computer PC is connected to an external network TN, and is connected to a specific server SV allowing downloads of programs and data for operating the printer PRT. A floppy disk drive FDD or CD-ROM drive CDD can also be used to load necessary programs and data from recording media such as floppy disks and CD-ROMs.

FIG. 1 also illustrates the structure of the function blocks of the printer PRT. The printer PRT is equipped with an inputter 91, buffer 92, primary scanner 93, and sub-scanner 94. A control parameter table 97 is provided as the table referenced by the primary scanner 93 and sub-scanner 94.

The inputter 91 receives printing data and printing mode data from the computer PC, which is temporarily stored in the buffer 92. The printing data given by the computer PC are data comprising half tone-processed image data that are to be printed, that is, data specifiying the dot on/off of each color for each two-dimensionally arranged pixel. The primary scanner 93 performs the primary scanning which involves the printer PRT head traveling back and forth in one direction based on the print data. Dots are formed by the operation of the head as it travels back and forth. The pixels for which the dots are to be formed by the primary scanning of the primary scanner 93 are determined at each primary scan and are pre-stored in the control parameter table 97.

The sub-scanner 94 performs the sub-scanning by which printing paper is conveyed until primary scanning is complete. In this example, sub-scanning is managed at a feed allowing raster lines to be formed in two primary scans. The feed varies according to printing mode, however. The fed is preset according to the pitch and number of head nozzles and the printing resolution, and is stored in the control parameter table 97 for each printing mode.

Figure 2:
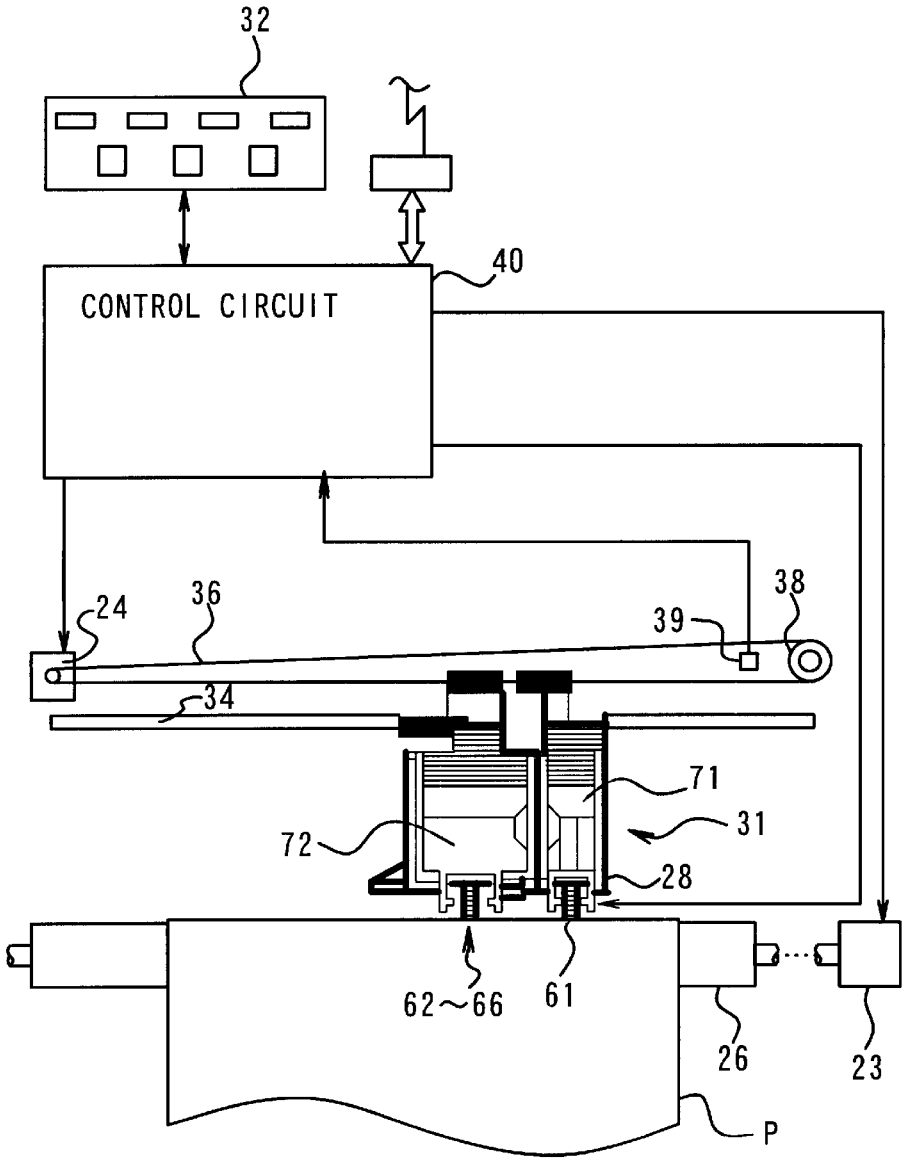
FIG. 2 illustrates the schematic structure of the printer PRT.

FIG. 2 is a schematic illustration of the structure of the printer PRT. As shown in the figure, the printer PRT includes a mechanism for conveying paper P by means of a paper feed motor 23, a mechanism for allowing the carriage 31 to travel back and forth in the axial direction of the platen 26 by means of a carriage motor 24, a mechanism for operating the printing head 28 mounted on the carriage 31 to discharge ink, and a control circuit 40 for controlling signal processing with the paper feed motor 23, carriage motor 24, printing head 28, and operating panel 32.

The mechanism which allows the carriage 31 to travel back and forth in the axial direction of the platen 26 includes a sliding shaft 34 that is suspended parallel to the axis of the platen 26, and that slidably retains the carriage 31; a pulley 38 for suspending an endless drive belt 36 between the carriage motor 24; and a position detection sensor 39 for sensing the point of origin position of the carriage 31.

A black ink (K) cartridge 71 and a color ink cartridge 72 housing cyan (C), light cyan (LC), magenta (M), light magenta (LM), and yellow (Y) are mountable on the carriage 31. A total of six ink discharging heads 61 through 66 are formed in the printing head 28 at the bottom of the carriage 31. When cartridges 71 and 72 are mounted on the carriage 31, ink is fed from the ink cartridges to the heads 61 through 66.

Figures 3, 5:
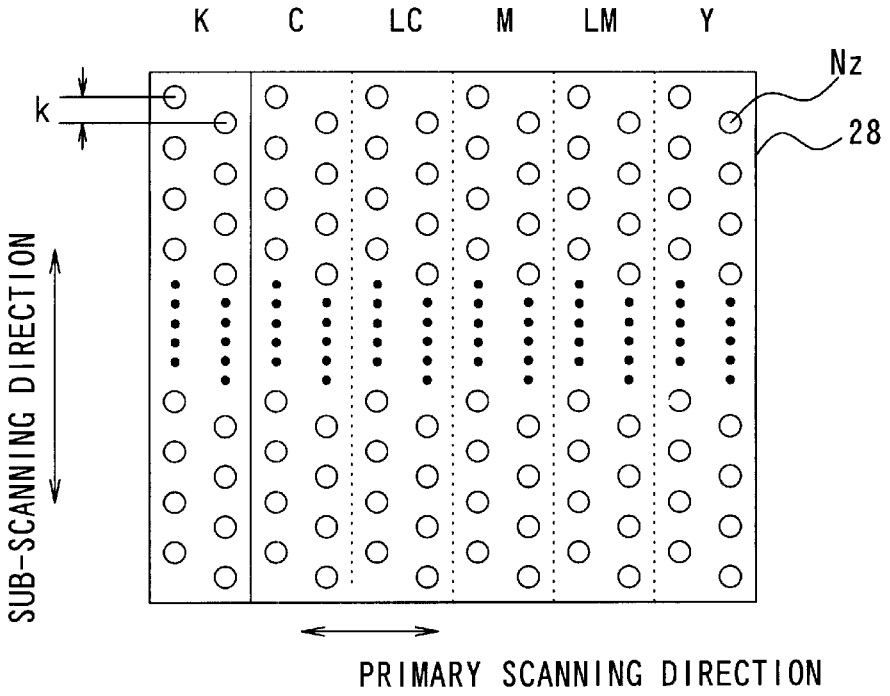
FIG. 3 illustrates the arrangement of nozzles Nz in heads 61 through 66.
FIG. 5 illustrates an example of a control parameter table.

FIG. 3 illustrates the arrangement of nozzles Nz in the heads 61 through 66. These nozzles consists of 6 sets of nozzle arrays for discharging ink of each color, where each nozzle array includes a plurality of nozzles Nz arranged in a zigzag pattern at a constant nozzle pitch k. The positions of the nozzle arrays are consistent with each other in the sub-scanning direction. The nozzle arrays for each color are arranged in the primary scanning direction as illustrated in the figure. The ink discharge sequence for each pixel thus varies depending on whether the pixel is formed during either the forward or return travel in primary scanning. In other words, ink is discharged in the sequence K, C, LC, M, LM, and Y for pixels formed during forward travel. Conversely, ink is discharged in the sequence Y, LM, M, LC, C, and K for pixels formed during return travel.

Ink is discharged from the nozzles by means of a mechanism featuring the use of piezo elements. In the nozzles of the heads 61 through 66 for each color, piezo elements are disposed in positions in contact with the ink channel conducting the ink up to the nozzles Nz. When voltage is applied to these piezo elements PE, the piezo elements PE undergo strain, causing the side walls of the ink channels to deform, and ink is discharged at a high rate from the tips of the nozzles.

Although this example features the use of a printer PRT comprising heads for discharging ink using piezo elements as described above, printers in which ink is discharged by another method may also be employed. An example of another type of printer is one in which electric power is applied to heaters disposed in the ink channels, and the ink is discharged by the resulting bubbles formed in the ink channels.

(2) Dot Formation Control

Figure 4:
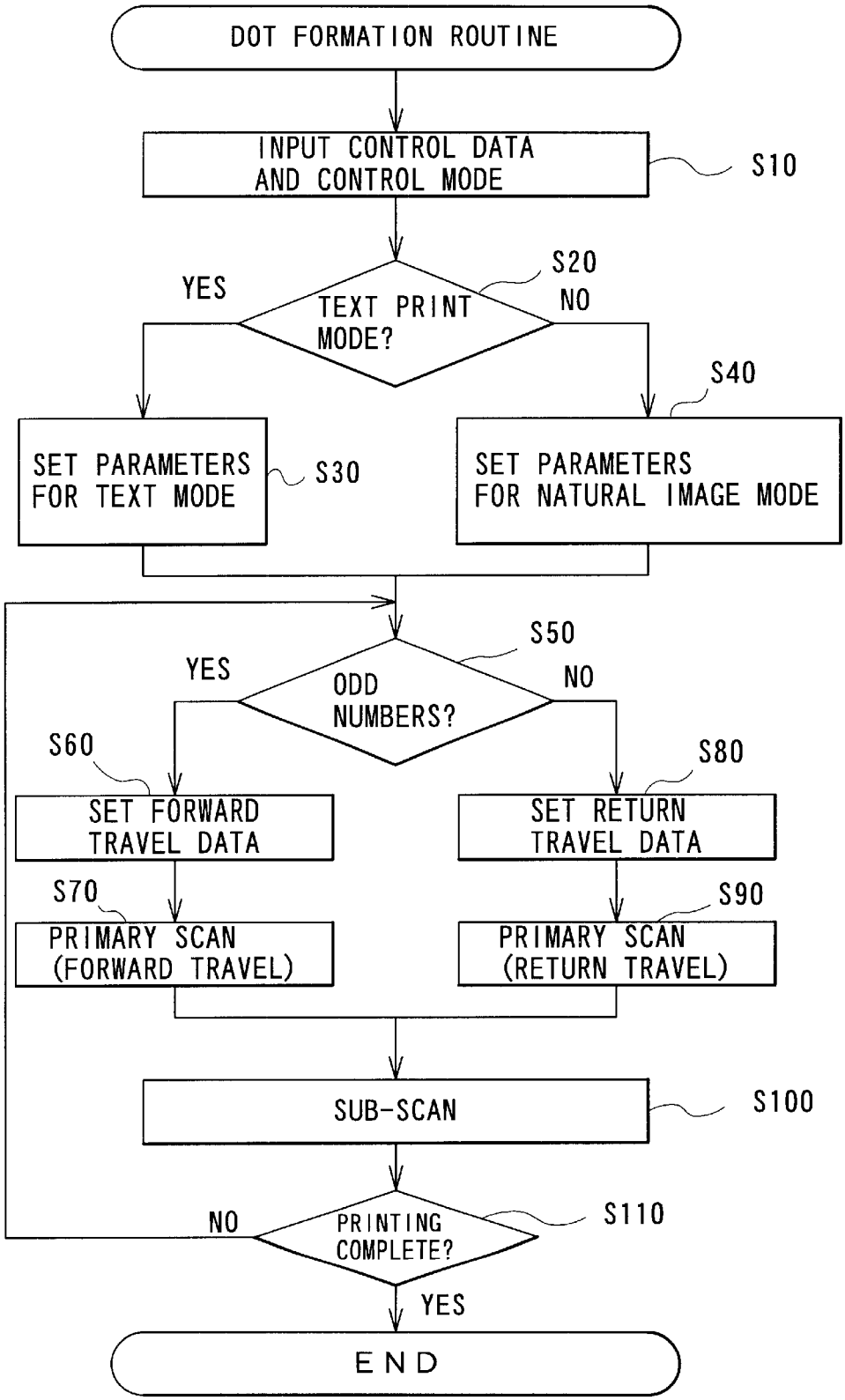
FIG. 4 is a flow chart of the dot forming routine.

The dot formation process in this example is described below. FIG. 4 is a flow chart of the dot forming routine. This is the process run by the CPU in the control circuit 40 of the printer PRT. When the process begins, the CPU inputs printing data and the printing mode (step S10). The printer data are data processed by the computer PC, and are data which represent dot on-off with a 1 or 0 for the ink of each color per pixel forming the image. When the CPU inputs the data, the data are temporarily stored in the RAM in the control circuit 40.

Printing modes include text printing mode for printing text images, and natural image printing mode for printing other images, so-called natural images. As described below, the positions of pixels for which dots are formed in primary scanning and the feed of the sub-scan (both henceforth referred to as control parameters) are different for the two modes. The CPU establishes the sub-scan feed according to each mode, and thus determines whether the input printing mode is a text printing mode (step S20).

Figure 7:
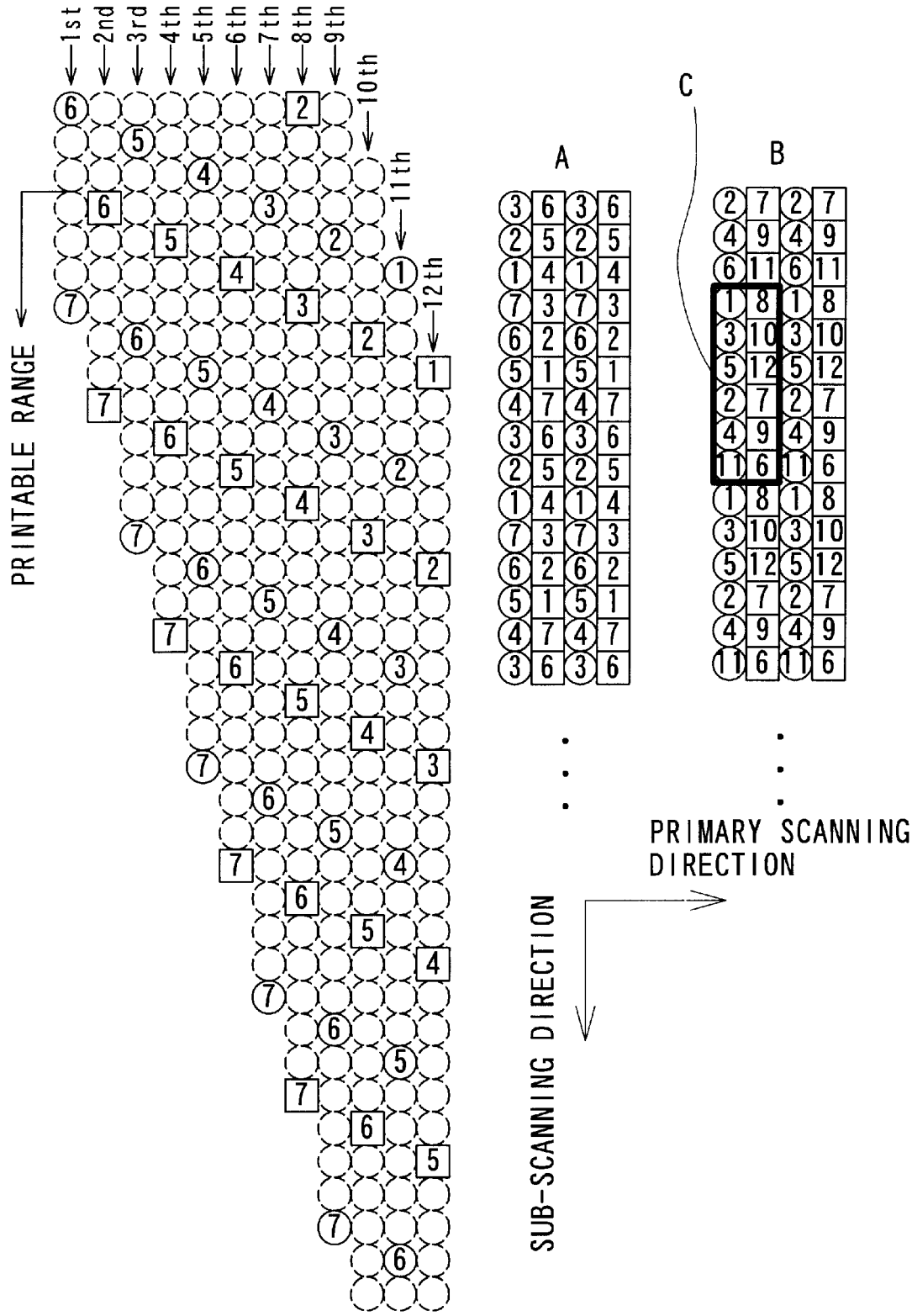
FIG. 7 illustrates the appearance of dots formed in text printing mode.

When text printing mode has been indicated, text control parameters are set (step S30). In this example, control parameters are preset according to each printing mode, and are stored in the form of a control parameter table. FIG. 5 illustrates an example of a control parameter table. As shown in the figure, the parameters are set so that 3-dot feed and 4-dot feed are repeatedly carried out for text printing mode. In this example, raster lines are formed by two primary scans, dots for pixels located in ODD, that is, odd numbers, are formed during forward travel, and dots for pixels located in EVEN, that is, even numbers, are formed during return travel. The control parameters depicted in FIG. 5 are values corresponding to the dot formation examples described below (FIG. 7).

Figure 6:
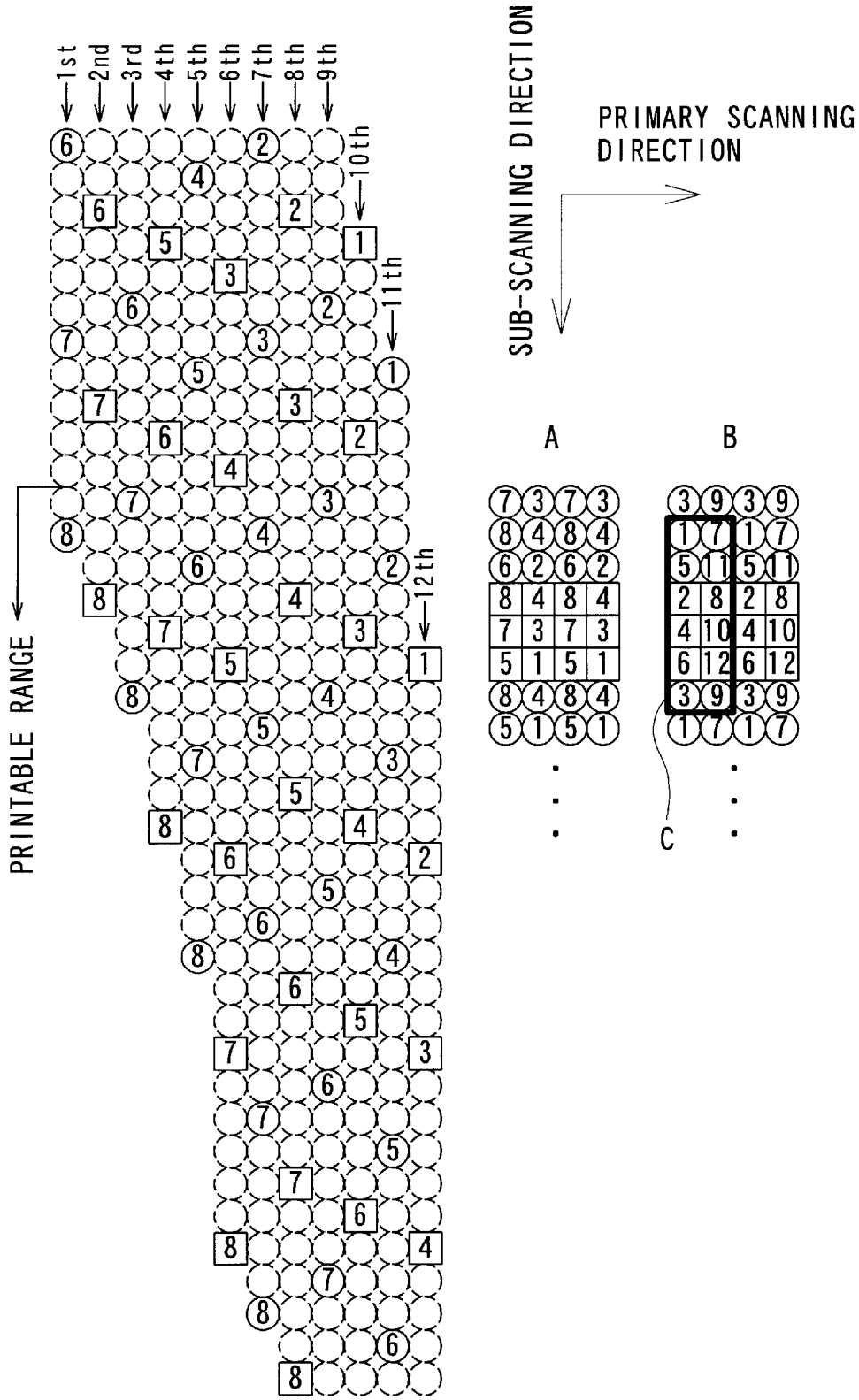
FIG. 6 illustrates the appearance of dots formed in natural image printing mode.

When natural image printing mode, and not text printing mode, is indicated, parameters for natural images are set (step S40). The natural image parameters are preset and stored in the control parameter table. As shown in FIG. 5, the parameters are set so that 2-dot, 3-dot, 4-dot, 4-dot, 9-dot, and 2-dot feed is repeatedly carried out for natural image printing mode. ODD dots are formed by the first primary scan, and EVEN dots are formed by the second primary scan. The first primary scan is the first primary scan for scanning raster lines, and the second primary scan is the second primary scan for scanning raster lines. The control parameters are values corresponding to the dot forming examples described below (FIG. 6).

When the control parameters corresponding to the printing modes are thus set, the CPU begins printing based on the control parameters. First, the CPU determines whether the primary scan being run is an odd-numbered scan (step S50). In this example, bi-directional printing was performed as described above. Odd-numbered primary scans were run during the forward travel of the carriage, and even-numbered primary scans were run during the return travel of the carriage. In step S50, when an odd-numbered primary scan is determined, forward travel data are set for the nozzles in the head (step S60). That is, print data for the pixels formed by such primary scans are set for the operating buffer in conjunction with the sequence corresponding to the operating direction of forward travel for each nozzle. When the data are thus set, dots are formed as the carriage travels forward in primary scanning (step S70).

In step S50, when an even-numbered primary scan is determined, return travel data are set for the nozzles in the head (step S80). Because the operating direction of the carriage is opposite that during forward travel, the sequence for the data for forming pixels is the opposite of that during forward travel. When the data are thus set, dots are formed as the carriage returns in primary scanning.

The pixels targeted for formation on raster lines differ according to the print mode in the primary scanning above.

When text printing mode is indicated, odd-numbered pixels are formed during forward travel, as indicated in the control parameter table in FIG. 5, and even-numbered pixels are formed during return travel. Accordingly, in text printing mode, the forward travel data setting and primary scanning (steps S60 and S70) are carried out only for odd-numbered pixels of the raster lines. The return travel data setting and primary scanning (steps S80 and S90) are carried out only for even-numbered pixels of the raster lines.

In natural image printing mode, odd-numbered pixels are formed in the first primary scan, and even-numbered pixels are formed in the second primary scan. The operating direction during either of forward and return travel can also correspond to both the first and second primary scans. In the first primary scan, some of the nozzles in the head can correspond to the first primary scan, and the remaining nozzles can correspond to the secondary scan. Data setting (steps S60 and S80) and primary scanning (steps S70 and S90) are carried out so that only odd-numbered or even-numbered pixels are formed, depending on whether the primary scan being run is either the first or second primary scan. The correlation between nozzles and the first and second primary scan is easily determined according to the control parameters, as noted above.

When primary scanning is finished, the CPU executes sub-scanning (step S100). Auxiliary scanning is carried out at the predetermined feed set in the control parameter table. The CPU repeatedly carries out the primary and sub-scans described above until printing is complete (step S110).

The appearance of the dots formed by the dot forming routing is described in a specific example. FIG. 6 illustrates the appearance of dots in natural image printing mode. For convenience, the example here is of 8 nozzles at a nozzle pitch of 6 dots.

The positions of the head in the sub-scanning direction during the 1st through 12th primary scans are shown on the left side of the figure. The numbered symbols in the figure indicate nozzles. The numbers indicate the nozzle number. Nozzles indicated by a circle correspond to odd-numbered primary scans, that is, positions during forward travel, and nozzles indicated by squares correspond to even-numbered scans, that is positions during return travel. When sub-scanning is performed at a feed of 2 dots, 3 dots, 4 dots, 4 dots, 9 dots, and 2 dots as shown in the control parameters in FIG. 4, images can be printed as raster lines are formed within the range given as the printable range in FIG. 6.

The appearance of dots in the printable range is shown on the right side of FIG. 6. The circles and boxes signifying dots correspond to the symbols for the nozzles forming the dots. The correspondence between the dots and nozzle numbers is shown in portion A. For example, in the first raster line at the top of the figure, the odd-numbered pixels are formed by the 7th nozzle, and the even-numbered pixels are formed by the 3rd nozzle. As is clear in Figure A, the 1st through 4th nozzles always form dots for even-numbered pixels in the second scan, and the 5th through 8th nozzles form dots for the odd-numbered pixels in the first scan. The correspondence between the first and second primary scans is thus easily determined according to the sub-scan feed.

The right side B segment of FIG. 6 shows the correspondence to the primary scans forming the pixels. That is, the number shows which primary scan the pixels were formed in. Here, in the example illustrated in FIG. 6, a head with a nozzle pitch of 6 dots in the sub-scanning direction was used, allowing raster lines to be formed in two primary scans. The dots for the image as a whole are thus formed by a sequence such that a region with a total of 12 pixels comprising 2 pixel segments in the primary scanning direction and 6 pixel segments in the sub-scanning direction, as shown in section C in the figure, is represented as a unit. Shown is the sequence by which dots are formed for 12 pixels serving as the unit in section C of the figure. Henceforth, in this Specification, the dot forming sequence will be described by the illustration of section C in the figure as needed.

As is clear from sections A and B on the right side in FIG. 6, in natural image printing mode, raster lines corresponding to forward travel (raster lines represented by circles in the figure) and raster lines corresponding to return travel (raster lines represented by boxes) are alternately formed in adjacent segments of three.

FIG. 7 illustrates the appearance of dots formed in text printing mode. For convenience, the example here is of 7 nozzles at a nozzle pitch of 6 dots. The symbols in the figure mean the same as the symbols in FIG. 6. As indicated by the control parameters in FIG. 4, when sub-scanning is performed at a feed of 3 dots and 4 dots, images can be printed while raster lines are formed in two primary scans in the range indicated as the printable range in FIG. 7.

Section A on the right side of FIG. 7 shows the correspondence between dots and nozzle numbers in the printable region. For example, in the first raster line at the top of the figure, the odd-numbered pixels are formed by the 3rd nozzle, and the even-numbered pixels are formed by the 6th nozzle. As is clear in Figure A, dots for the odd-numbered pixels are always formed in the first primary scan during forward travel, and dots for the even-numbered pixels are formed in the second primary scan during return travel. The correspondence between the first and second primary scans is thus easily determined according to the sub-scan feed.

The right side B segment of FIG. 7 shows the correspondence to the primary scans forming the pixels. That is, the number shows which primary scan the pixels were formed in. In the same manner as illustrated in FIG. 6, the dots for the image as a whole are formed by a sequence such that a region with a total of 12 pixels comprising 2 pixel segments in the primary scanning direction and 6 pixel segments in the sub-scanning direction, as shown in section C in the figure, is represented as a unit. Shown is the sequence by which dots are formed for 12 pixels serving as the unit in section C of the figure.

As is clear from sections A and B on the right side in FIG. 7, in text image printing mode, the primary scanning direction positions for pixels corresponding to forward travel (pixels represented by circles in the figure) and pixels corresponding to return travel (pixels represented by boxes) are in agreement. That is, odd-numbered pixels are formed during forward travel, and even-numbered pixels are formed during return travel.

Figure 8:
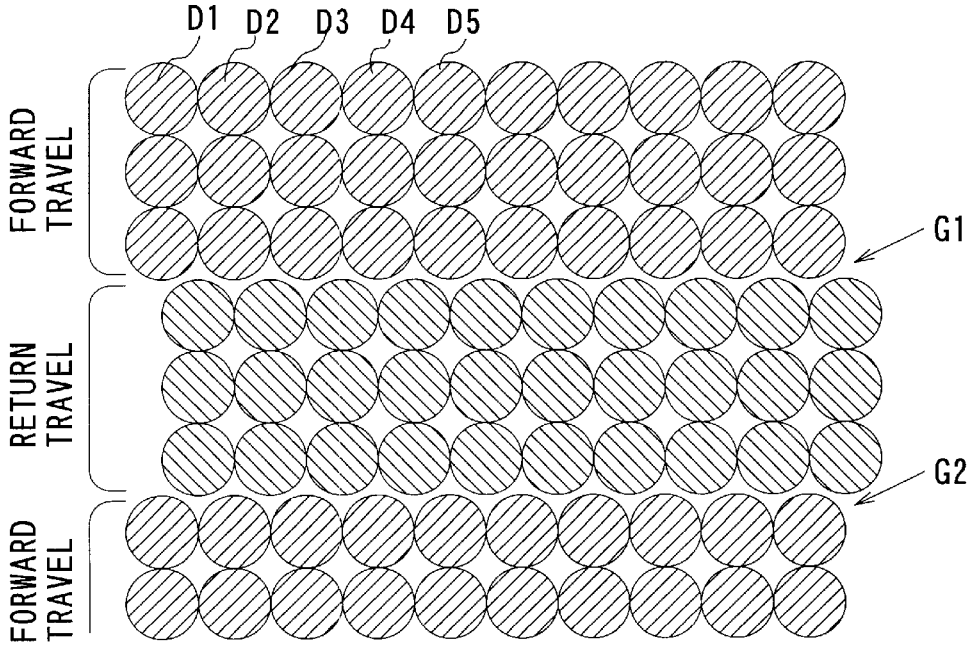
FIG. 8 illustrates a plurality of adjacent raster lines formed in text print mode.

The printing device in the example described above allows natural images and text images to be printed with high image quality. FIG. 8 illustrates the appearance of dots formed in natural image printing mode. Eight-raster line segments are depicted here. As noted above, in natural image printing mode, raster lines corresponding to forward travel and raster lines corresponding to return travel are alternately formed in three-raster line segments. In bi-directional printing, the positions where dots are formed during forward travel and dots formed during return travel sometimes shift in the primary scanning direction as a result of backlash or the like. In such cases, the shifts are discernible in locations where raster lines with different directions of formation are adjacent to each other, that is, the two locations G1 and G2 in the figure.

Figure 9:
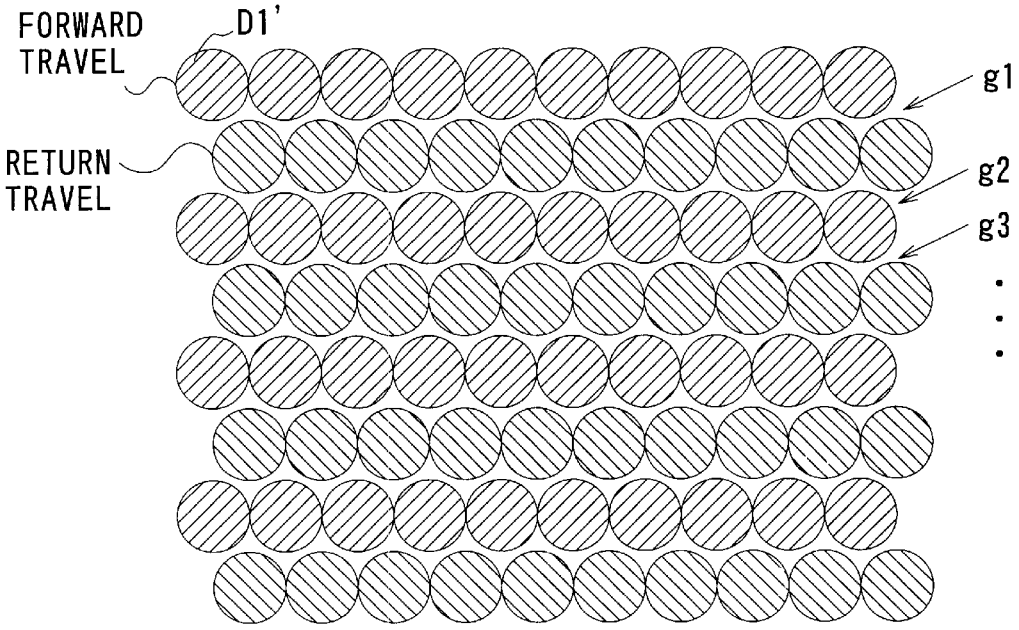
FIG. 9 illustrates adjacent raster lines formed in different directions.

FIG. 9 illustrates a comparative example of a case of different raster line forming directions for each raster line. Eight-raster line segments are depicted in the same manner as in FIG. 8. In this case, as shown in the figure, shifts in the primary scanning direction between raster lines are discernible in a total of 7 locations comprising g1, g2, g3, etc.

A comparison of FIGS. 8 and 9 makes clear that the formation of 3 adjacent raster lines formed in the same direction in the printing device results in fewer discernible shifts between raster lines. Because the printing device in this example prints at a relatively high resolution, the surface area of locations G1 and G2 where shifts are discernible have relatively little effect on image quality, whereas the number of locations where shifts occur has a greater effect on image quality. When shifts occur in a large number of locations, the image as a whole will appear grainy, resulting in rougher images overall. In the printing device in this example, there are fewer numbers of regions in which shifts can occur, allowing grainy images to be improved and better image quality to be achieved. Segments of three adjacent raster lines formed in the same direction were also formed in this example, but the number of adjacent raster lines can be variously set according to nozzle pitch and the number of nozzles by taking into consideration the effects on image quality and the dot formation efficiency.

Figure 10:
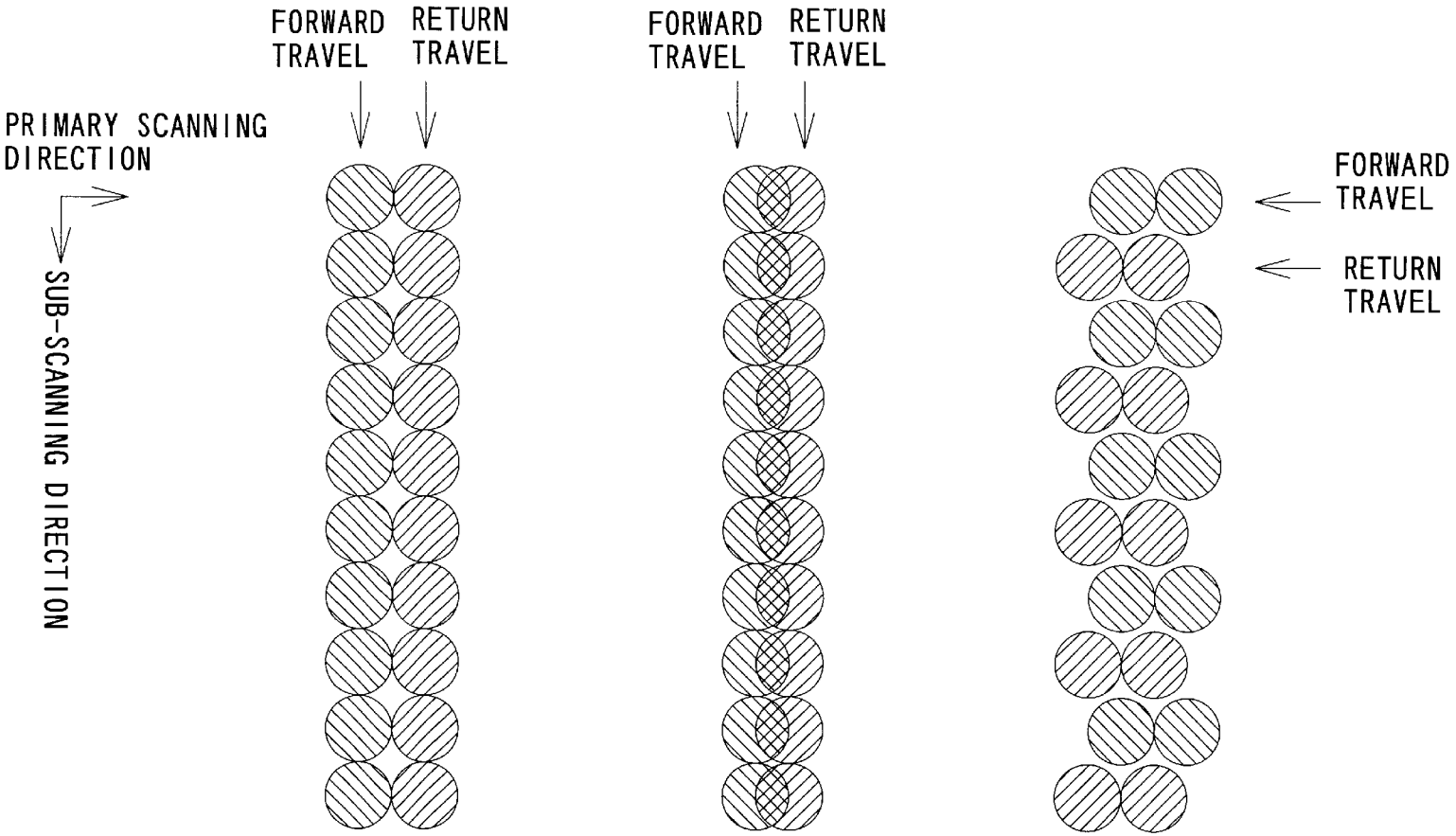
FIG. 10 illustrates the appearance of dots formed in text printing mode.

The printing device in this example can also improve image quality in text image printing. FIG. 10 illustrates the appearance of dots formed in text printing mode. As described earlier, in text printing mode, odd-numbered pixels are formed during forward travel, and even-numbered pixels are formed during return travel. Left side of FIG. 10 shows a case in which dots were formed without any shifts in the forming positions during forward and return travel. The example depicts ruled lines that are two-pixels wide in the sub-scanning direction.

Middle of FIG. 10 illustrates the appearance of shifts occurring in positions during forward and return travel. As shown in the figure, positions where the odd and even-numbered pixels were formed have uniformly shifted in the primary scanning direction. The ruled lines are easily discerned in the form of straight lines.

For comparison, right side of FIG. 10 illustrates an example in which the direction of formation is aligned for each raster line. Two pixels are formed in the same direction on each raster line, which are formed alternately, from above, during forward and return travel. This example shows the appearance of dots when shifts occur in the direction of formation during forward and return travel in a case where raster lines are formed in such a manner. When shifts occur in the direction of formation, the ruled lines appear to undulate.

Alignment of the direction in which the dots are formed for pixels of the same position in the primary scanning direction allows straight lines in the sub-scanning direction to be printed more accurately, despite shifts in the forming positions during forward and return travel. The accuracy of such strain lines affects image quality more than the overall graininess of text images. The printing device in this example thus can realize higher image quality printing even in text printing mode. In this example, pixels formed during forward travel and pixels formed during return travel were arranged alternately in the primary scanning direction. In text mode printing, there should be a one-to-one correspondence between the position in the primary scanning direction and the direction of formation. A plurality of adjacent pixels formed during forward travel and pixels formed during return travel may also be adjacent to each other in the primary scanning direction.

As described above, the printing device in this example is capable of high speed printing through bi-directional printing. High image quality printing is also achieved through overlapping format printing, where raster lines are formed in two primary scans, and interlaced format printing using heads with a nozzle pitch of 6 dots. As also noted above, images which are grainy overall can be improved in natural image printing mode by forming a plurality of adjacent raster lines formed in the same direction. In text printing mode, meanwhile, text images can be printed more accurately by forming dots with a one-to-one correspondence between the position in the primary scanning direction and the direction of formation. These actions allow the printing device in this example to print images at high speed and with better image quality.

This example illustrated the use of separate control parameters according to whether or not text printing mode had been indicated. The use of separate control parameters can be employed in various ways. For example, separate control parameters may be used according to the type of printing media. Such a case is described below in a variant example.

FIG. 4 illustrates a flow chart for the use of separate control parameters according to the type of printing media. In this variant example, the type of printing medium is input as a printing mode (step S10). Examples of printing media include ordinary paper, special paper, and the like. Special paper has better ink absorption and allows the formation of finer dots, and can thus be employed for high image quality printing.

In step S20 of the preceding example, separate control parameters were used depending on whether or not text printing mode was selected. In this variant example, on the other hand, separate control parameters are used according to the type of printing medium indicated. Here, when ordinary paper is indicated, text parameter settings are used (step S30). When special paper is indicated, natural image parameters are used (step S40). The process after the control parameters have been set according to the printing medium are the same as previously. That is, the process from steps S50 to S110 in FIG. 4 are repeated to print images by bi-directional printing.

As noted above, the use of separate control parameters allows dots to be formed as depicted in FIG. 7 when ordinary paper is indicated. That is, the direction in which the dots are formed is aligned for pixels of the same position in the primary scanning direction. When special paper is indicated, dots are formed as illustrated in FIG. 6. That is, the direction in which the dots are formed for each raster line is aligned, and a plurality of raster lines formed in the same direction are adjacent to each other.

In general, printing media are intended for particular used depending on the type of medium. As noted above, special paper is suitable for high image quality printing. It is thus often used to print natural images. Ordinary paper usually affords lower image quality than special paper, but is less expensive. It is thus often used to print so-called text documents. In this variant example, dots are formed in a manner befitting text printing (FIG. 7) for ordinary paper. Dots are formed in a manner befitting natural image printing (FIG. 6) for special paper. Printing suited to the intended use can thus be managed for each type of printing medium.

In the preceding example, two types of printing medium, ordinary and special paper, could be selected. When even more types of printing media are available, dots can similarly be formed in a manner befitting the intended use, thereby improving the image quality in each type of printing medium. The use of separate control parameters according to printing medium need not necessarily depend on the intended use of each printing medium. For example, the way in which dots are formed on printing media can also be set in consideration of the ink yield, which differs for each type of printing medium.

In the preceding example, separate control parameters were used depending on the type of images being printed, that is, whether the images were text images or natural images. In the variant example, separate control parameters were used depending on the type of printing medium. Separate control parameters are not limited to these. Separate control parameters can also be used according to a variety of printing conditions, such as resolution. Example 2 below specifically illustrates changes in the way the dots are formed depending on the resolution.

(3) Example 2

A second example of a printing device is described below. The hardware structure of the printing device in Example 2 is the same as that in Example 1. The flow chart of the dot forming routine is also the same as that in Example 1. The control parameter table and its separate uses in Example 2 are different from those in Example 1.

FIG. 11 illustrates an example of the control parameter table for Example 2. Here, only the sub-scan feed for natural image printing mode is shown. The feed corresponds to a case of 96 nozzles at a pitch of 4 dots. As shown in the figure, sub-scanning in Example 2 is performed at different feeds according to the resolution during printing.

Auxiliary scanning is performed at a constant feed of 47-dot segments when the printing mode has a low resolution, that is, a resolution of 360 DPI (dots per inch) in the primary scanning direction and a resolution of 720 DPI in the sub-scanning direction. FIG. 12 illustrates the appearance of the dots formed at a low resolution. Auxiliary scanning at the feed allows overlapping format printing to be performed to form raster lines in two primary scans. The dot forming sequence in FIG. 12 is represented in the same manner as section C in FIGS. 6 and 7 above. As shown in the figure, the dots of the image as a whole are formed by the same sequence, where a unit includes a total of 8 pixels involving 2 pixels in the primary scanning direction and 4 pixels in the sub-scanning direction. Picture elements on the raster lines are formed in the same direction, as illustrated in FIG. 12, depending on the control parameters during low resolution. The raster lines formed during forward travel and the raster lines formed during return travel are alternately adjacent.

A feed of 22 dots, 25 dots, 22 dots, and 23 dots is repeated, as shown in FIG. 11, when the printing mode has an intermediate resolution, that is, a resolution of 720 DPI in the primary and sub-scanning directions. FIG. 13 illustrates dots formed at an intermediate resolution. Auxiliary scanning at the feed allows overlapping format printing to be performed to form raster lines in four primary scans. The dot forming sequence in FIG. 13 is represented in the same manner as section C in FIGS. 6 and 7 above. As shown in the figure, the dots of the image as a whole are formed by the same sequence, where the unit includes a total of 16 pixels involving 4 pixels in the primary scanning direction and 4 pixels in the sub-scanning direction. Picture elements on the raster lines are formed in the same direction, as illustrated in FIG. 13, depending on the control parameters during intermediate resolution. The raster lines formed during forward travel and the raster lines formed during return travel are formed in adjacent two-raster line segments.

Figure 14:
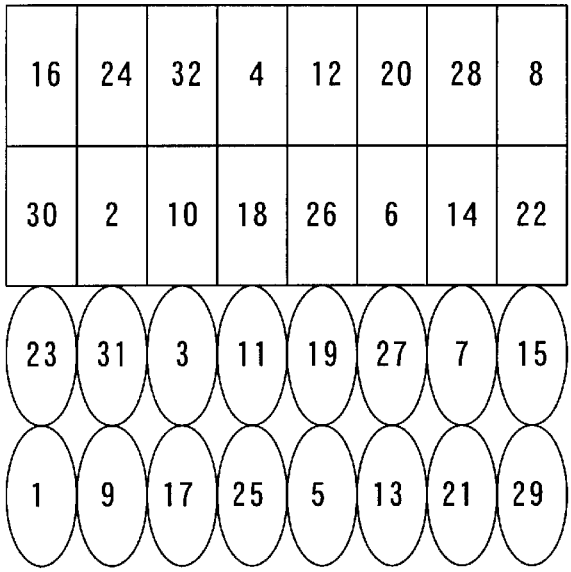
FIG. 14 illustrates the appearance of dots formed at high resolution.

A feed of 10 dots, 13 dots, 10 dots, and 11 dots is repeated, as shown in FIG. 11, when the printing mode has a high resolution, that is, a resolution of 1440 DPI in the primary scanning direction and 720 DPI in the sub-scanning direction. FIG. 14 illustrates dots formed at a high resolution. Auxiliary scanning at the feed allows overlapping format printing to be performed to form raster lines in eight primary scans. The dot forming sequence in FIG. 14 is represented in the same manner as section C in FIGS. 6 and 7 above. As shown in the figure, the dots of the image as a whole are formed by the same sequence, where the unit includes a total of 32 pixels involving 8 pixels in the primary scanning direction and 4 pixels in the sub-scanning direction. Picture elements on the raster lines are formed in the same direction, as illustrated in FIG. 14, depending on the control Parameters during high resolution. The raster lines formed during forward travel and the raster lines formed during return travel are formed in adjacent two-raster line segments.

FIGS. 12 through 14 show images of pixels at various resolutions. This does not mean that the elliptical dots of the size indicated are formed at the corresponding resolutions in FIGS. 12 and 14. The width of the pixels in the primary and sub-scanning directions in the figures are shown at a ratio corresponding to the various resolutions, but for the sake of convenience, the relative size between FIGS. 12 through 14 does not match the relationship of the resolution levels.

For intermediate or high resolution printing, the printing device in Example 2 improves the overall graininess of images and improves image quality by allowing a plurality of raster lines formed in the same direction to be formed adjacent to each other in the same manner as in Example 1. Meanwhile, it also improves image quality at low resolution by allowing raster lines formed in different directions to be formed adjacent to each other. The reasons are discussed below.

Figure 15:
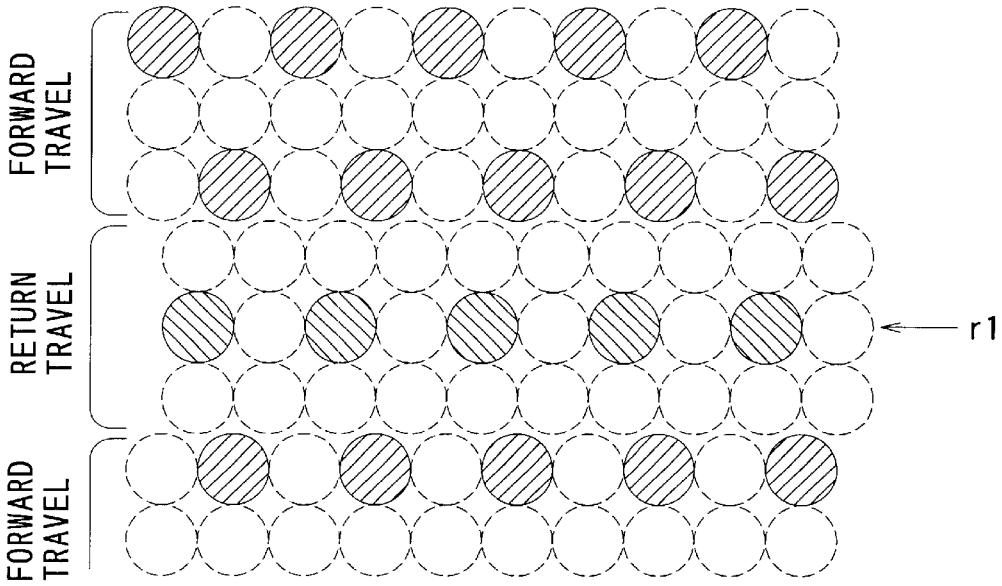
FIG. 15 illustrates a plurality of adjacent raster line formed in the same direction at a low printing rate.
Figure 16:
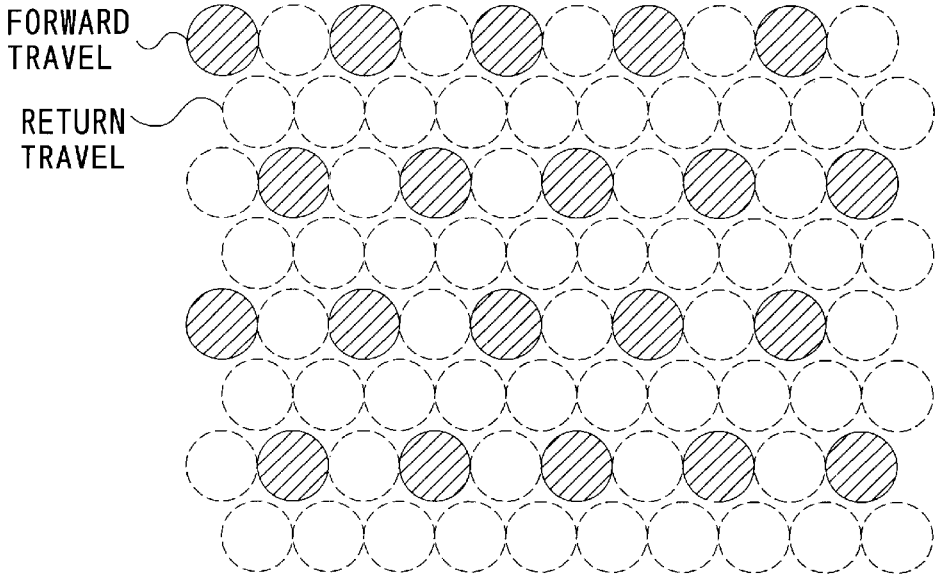
FIG. 16 illustrates a plurality of adjacent raster line formed in different directions at a low printing rate.

FIGS. 15 and 16 illustrate the appearance of dots when low resolution is indicated. FIG. 15 corresponds to the printing in FIG. 8 described above. That is, printing is such that, from the top, raster lines formed in different directions alternate in groups of three. FIG. 16 corresponds to the printing in FIG. 9. That is, raster lines formed during forward travel and raster lines formed during return travel alternate one raster line at a time.

Figure 17:
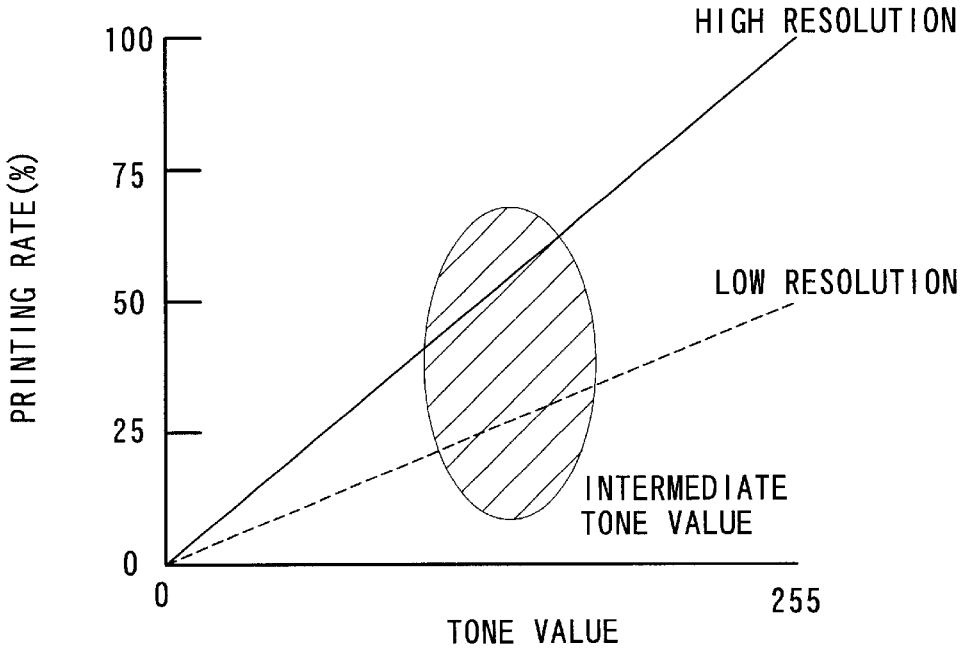
FIG. 17 illustrates the relationship between resolution and printing rate.

Here, for the convenience of description, the relation between resolution (FIGS. 8 and 9) and the pixel size and dot diameter have been made uniform to facilitate the comparison with FIGS. 8 and 9. In actuality, in the case of low resolution, the size of the pixels will be larger, and the diameter of the dots being used for printing will be larger. The increase in the diameter of the dots used results in a lower printing rate in each multi-tone. FIG. 17 illustrates the relationship between resolution and printing rate. The printing rate correlation differs according to the dot diameter used for each level of resolution, but at a low resolution in this example, dots are printed at a printing rate nearly half that during high resolution. The effects of roughness caused by shifts in the positions at which dots are formed is generally extremely obvious in intermediate multi-tones. As shown in FIG. 17, the printing rate is about 25% in an intermediate multi-tone at a low resolution in this example.

FIGS. 15 and 16 illustrate the appearance of dots formed in intermediate tones in low resolution mode. At a printing rate of about 25%, dots are formed with sufficient retention of dispersion, so that nearby dots are formed per pixel in the primary and sub-scanning directions. When dots are alternately printed in three-raster line segments in different directions at such a printing rate, the raster line r1, as shown in FIG. 15, is formed in a different direction than the direction in which the adjacent raster lines above and below are formed. That is, the direction in which the dots are formed is locally aligned around raster line r1. As a result, there are relatively more locations where shifts in the dot forming positions occur, resulting in rougher images. By contrast, when the direction in which the raster lines are formed alternates one raster line at a time, the direction in which the nearby dots are formed is aligned, as shown in FIG. 16. As a result, the locations where shifts in the dot forming positions occur can be reduced, allowing image roughness to be suppressed. Image quality can thus be improved by printing as shown in FIG. 16 in cases of low resolution.

The printing device in Example 2 described above allows image quality to be improved by suitably controlling the direction in which raster lines are formed according to resolution when natural images are printed. Three levels of resolution were illustrated in Example 2, but image quality can similarly be improved at other levels of resolution by controlling the direction in which the raster lines are formed based on the dot printing rate in intermediate multi-tones. The number of primary scans for forming raster lines at each resolution can be set in a variety of ways, not only as shown in FIGS. 11 through 14.

In Example 2, the way the raster lines were formed was different according to the resolution. The relationship between the resolution and the way the raster lines are formed can be set in a variety of ways. In Example 2, the way the raster lines were formed was changed based on the relative relationship between the resolution in the primary scanning direction and the resolution in the sub-scanning direction. That is, when the resolution in the primary scanning direction was lower than the resolution in the sub-scanning direction (360 DPI ( 720 DPI in FIG. 11), the raster lines were formed by switching the forward and return travel per raster line. When the resolution in the primary scanning direction was the same as or higher than the resolution in the sub-scanning direction (720 DPI (720 DPI and 1440 DPI ( 720 DPI in FIG. 11), a plurality of adjacent raster lines were formed in the same direction.

The ways in which the raster lines are formed can also be based on the relationship of the magnitude between the resolution during printing and the predetermined preset values. For example, in cases of printing at a resolution lower than 720 DPI, raster lines may be formed by switching the forward and return travel per raster line. In such cases, printing can be done by switching the forward and return travel per raster line during printing at 360 DPI (360 DPI, for example.

(4) Setting Control Parameters

Figure 18:
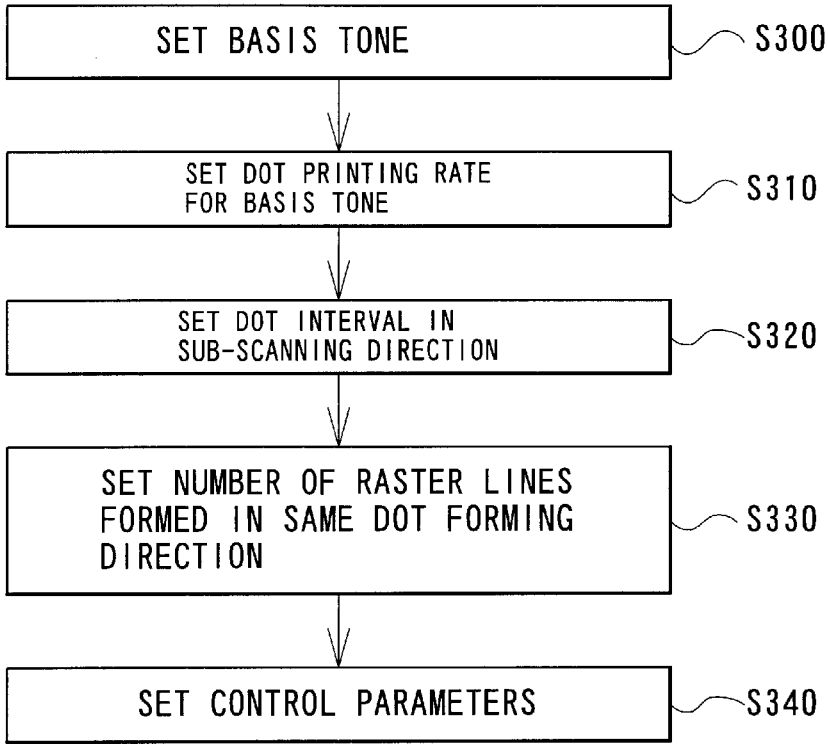
FIG. 18 illustrates a method for determining control parameters.

Methods for setting control parameters are described below. FIG. 18 illustrates a method for setting control parameters. This is an example in which the direction of formation is aligned for each raster line. First, the multi-tone serving as a basis for setting the control parameters is specified, and the dot printing rate in the basis multi-tone is specified (steps S300 and S310). Comparison of FIGS. 8 and 9 with FIGS. 15 and 16 clearly shows that the control parameters allowing the dot forming direction to be locally aligned are different according to the dot printing rate. The dot printing rate varies according to the desired multi-tone value.

Here, a multi-tone is selected for achieving better image quality by the local alignment of the direction in which the dots are formed. Roughness caused by shifts in the Positions at which dots are formed is generally extremely obvious in intermediate tones. Thus, in step S300, such intermediate tones should normally be selected. More specifically, samples should be printed in a broad multi-tone, and multi-tone values at which roughness is extremely obvious should be selected. When a multi-tone has been selected, the printing rate corresponding to the multi-tone can be easily determined according to half tone process. According to the example in FIG. 17, when intermediate tones have been selected as the basis multi-tone, the printing rate is about 50% in high resolution mode, and about 25% in low resolution mode.

The interval in the sub-scanning direction between dots formed nearby is then specified according to the printing rate thus specified (step S320). In ordinary half tone processes, the dot on/off is determined for each pixel so as to ensure sufficient dispersion. The average shape pattern of the dots can thus be specified according to printing rate, and the interval in the sub-scanning direction can also be specified. The interval in the sub-scanning direction does not usually have to be constant for all dots. The average value should be used for the interval to be specified here.

As shown in FIG. 8, when the dot printing rate is around 100%, the dots are formed on raster lines, so the interval in the sub-scanning direction corresponds to 1 dot. Similarly, in cases where the printing rate is higher than 50%, the interval in the sub-scanning direction corresponds to 1 dot. As shown in FIG. 15, when the printing rate is about 25%, the interval in the sub-scanning direction corresponds to 2 dots. The interval in the sub-scanning direction can thus be specified according to the printing rate. In this example, the direction of formation is aligned for each raster line. When dots formed in different directions are arranged on raster lines, the interval in the sub-scanning direction is preferably set simultaneously in step S320.

The number of raster lines in the same direction is specified on the basis of the parameters specified above, so that the direction in which the dots are formed is locally aligned (step S330). The number of raster lines in the same direction means how many raster lines formed in the same primary scanning direction are adjacent to each other. For example, in cases where the dot printing rate is about 50%, when a plurality of adjacent raster lines are formed in the same direction as indicated in FIG. 8, the direction in which the dots are formed can be locally aligned. In the example depicted in FIG. 8, the direction in which the raster lines are formed is changed every 3 raster lines, so the number of raster lines in the same direction is 3. When the dot printing rate is about 25%, the direction in which the raster lines are formed should be changed every raster line, as shown in FIG. 16. The number of raster lines in the same direction would thus be 1.

Figure 19:
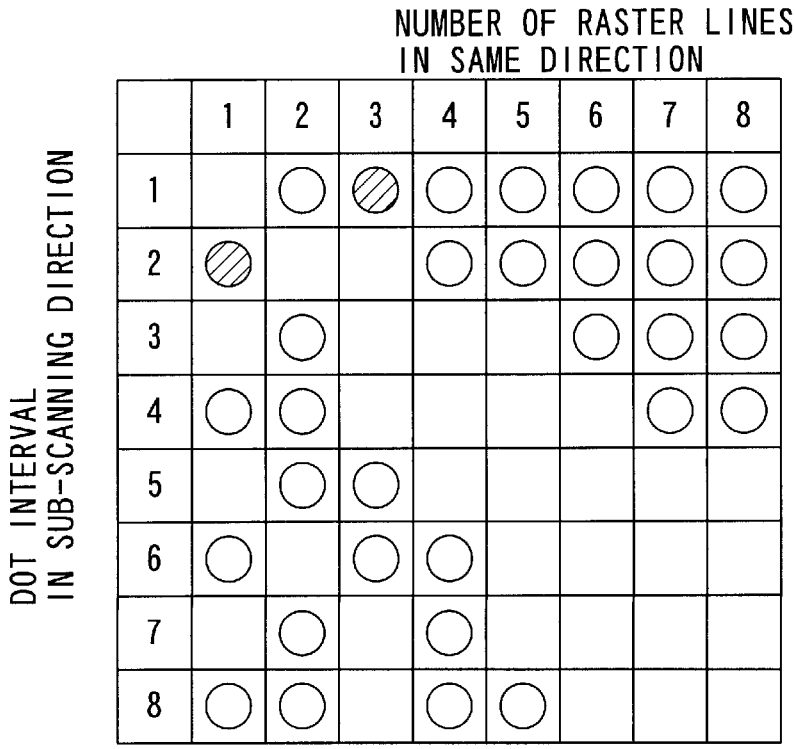
FIG. 19 illustrates the relationship between the dot interval in the sub-scanning direction and the number of raster lines formed in the same direction.
Figure 20:
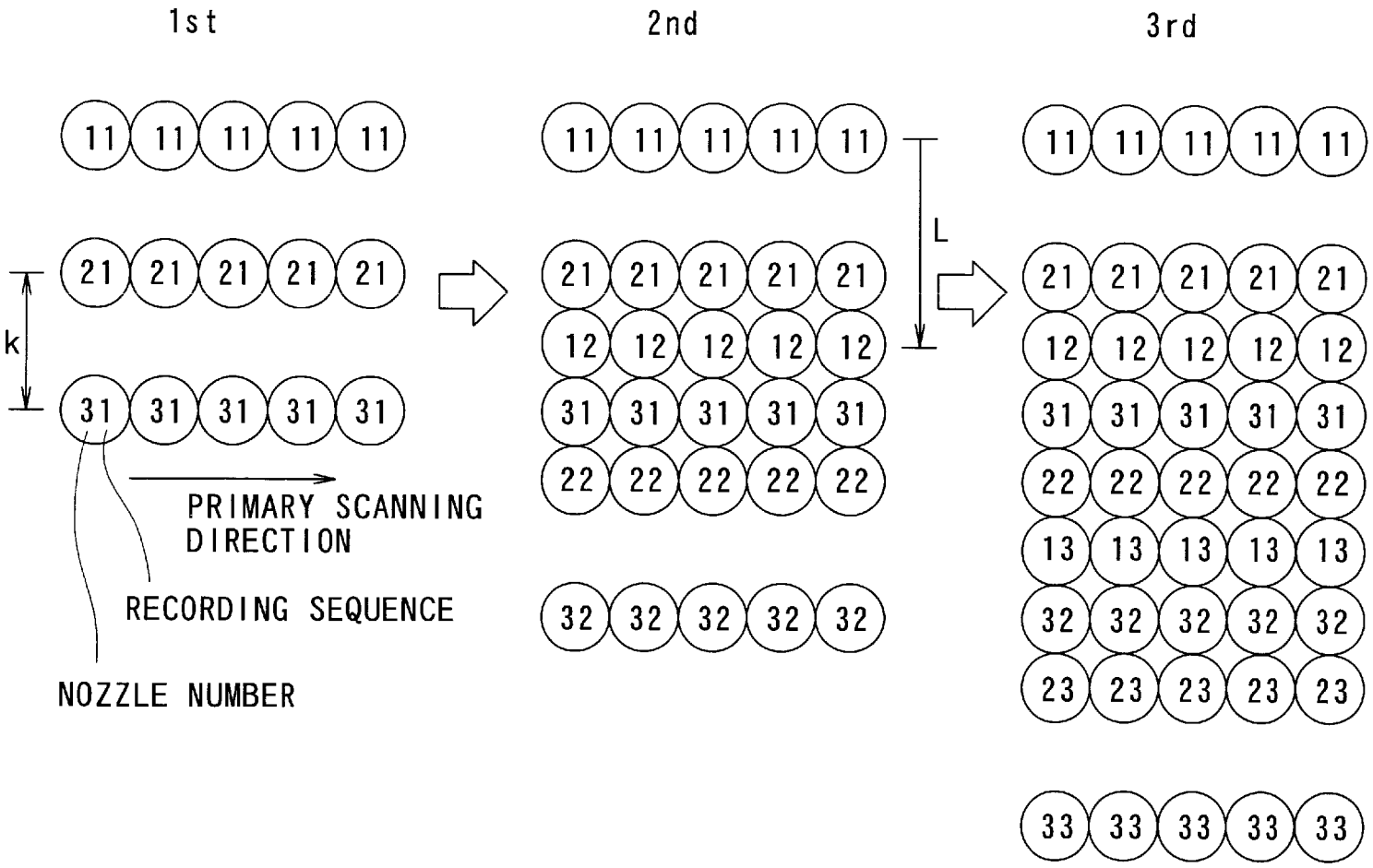
FIG. 20 illustrates an example of the interlaced format.

The number of raster lines in the same direction can be determined in various ways relative to the dot interval in the sub-scanning direction. FIG. 19 illustrates the relationship between the dot interval in the sub-scanning direction and the number of raster lines formed in the same direction. The figure indicates whether the direction of formation can be locally aligned with values of 1 up to 8 for the number of raster lines formed in the same direction relative to values of 1 through 8 for the dot interval. The printing depicted in FIGS. 8 and 16 correspond to combinations of hatchings in the figures.

In FIG. 19, a circle indicates a combination of two dots, which have been formed in the same direction, lined up in the sub-scanning direction. Numbers where dots, which have been formed in the same direction, are lined up in the sub-scanning direction are not aligned in each combination in the figure. Printing with combinations in which most dots are lined up in the sub-scanning direction can reduce the locations in which shifts in the dot forming positions can occur, thus allowing smoother printing to be achieved. Which combination to use should be selected in consideration of requirements such as the number of primary scan needed for printing, as well as the desired smoothness and resolution. The control parameters for primary and sub-scanning can be determined based on the selected combination (step S340). When the control parameters are set by means of such a step, it is relatively easy to set control parameters allowing printing to be achieved with less image roughness according to the printing resolution.

All the examples described above were of cases featuring the use of the overlapping format to form raster lines in two or more primary scans. The present invention is not limited to this method, and can also be used when raster lines are formed only in one primary scan, that is, during forward or return travel. The examples were also of cases in which text printing mode or natural image printing mode was used separately as indicated. The present invention can also be used with just a mode corresponding to natural image printing mode. In the examples, the direction in which the dots were formed was controlled in intermediate tones, but regions other than intermediate tones may also be set as the specified multi-tone range.

Although various embodiments of the present invention were described above, the present invention is not limited to these alone. Other variations are possible within the scope and range of the present invention. For example, various control processes described in the examples above may be managed, in part or in whole, by hardware.

What is claimed is:

1. A printing device for printing multi-colored images on a printing medium, comprising:

a print head including a plurality of nozzles for each color to jet ink, the plurality of nozzles for each color being arranged along a predetermined sub-scanning direction at intervals of two or more raster lines;

a primary scanning mechanism that moves the print head back and forth relative to the printing medium in a primary scanning direction perpendicular to the sub-scanning direction;

a sub-scanning mechanism that conveys the printing medium relative to the print head in the sub-direction;

a memory for storing control parameters including a sub-scan feed amount and positions of pixels that are to be formed during each primary scan, the control parameters being set such that pixels within the image are classified into groups each collected two dimensionally within a local are and that dots of each ink to be formed at the pixels in an identical group are all formed in an identical moving direction of the primary scan within a predetermined tone range; and a head drive controller for driving the print head during the primary scan to form dots at the pixels specified by the control parameters.

2. A printing device according to claim 1, said predetermined multi-tone range including intermediate tones.

3. A printing device according to claim 1, wherein the control parameters are set such that the dots of each ink to be formed at the pixels on an identical raster line are all formed in an identical moving direction of the primary scan.

4. A printing device according to claim 1, wherein said control parameters set furthermore in compliance with conditions allowing the said raster lines to be formed by a plurality of primary scans.

5. A printing device according to claim 1, wherein said memory stores said control parameters for each printing resolution available in the printing device, the printing device further comprising:

a resolution setting unit for setting a resolution during printing; and a printing controller for controlling said head drive controller and said sub-scanning mechanism to execute printing based on the control parameters according to said resolution.

6. A printing device according to claim 1, wherein said memory stores said control parameters for each type of printing medium available in the printing device, the printing device further comprising:

a printing medium setting unit for setting a type of printing medium; and a printing controller for controlling said head drive controller and said sub-scanning mechanism to execute printing based on control parameters according to said printing medium.

7. A printing device according to claim 1, further comprising:

a printing mode setting unit for determining whether or not text images are to be printed; and a printing controller for controlling said head drive controller and said sub-scanning mechanism to execute printing based on control parameters only when the text image printing mode has been set.

8. A printing device according to claim 7, wherein said memory stores text printing control parameters, including a sub-scan feed amount and positions of the pixels that are to be formed during each primary scan, the control parameters being set such that each raster line within the image is formed by a plurality of primary scans, and the dots to be formed at the pixels in an identical position of each raster line are all formed in an identical moving direction of the primary scan; and said printing controller comprises executes printing based on the text printing control parameters instead of said control parameters when the text image printing mode has been selected.

9. A printing device according to claim 1, wherein said nozzles for each color are arranged in the sub-scanning direction at predetermined intervals of 3 or more raster lines.

10. A printing device for printing multi-colored images by means of primary scanning, in which a head travels back and forth relative to a printing medium to form raster lines, and sub-scanning, in which said printing medium is conveyed relative to said head in the direction across to said primary scanning direction, so as to form dots for pixels on said printing medium, said head including, in said sub-scanning direction, at intervals of two or more raster lines per color, a plurality of nozzles for discharging ink, wherein said printing device comprises:

memory for storing first control parameters, including the position of the pixels that are to be formed during each primary scan, and the feed of the sub-scan set in compliance with conditions allowing the direction of the primary scan during the formation of dots to be aligned during either the forward or return travel for each raster line, and conditions under which two or more raster lines formed in each direction of primary scanning are adjacent to each other;

head drive controller for driving said head while moving back and forth in said primary scanning to form dots for the pixels specified by said control parameters; and sub-scanning mechanism for effecting sub-scanning at a feed specified by said control parameters.

11. A printing device according to claim 10, further comprising:

resolution setting unit for setting the a resolution during printing as a printing condition; and printing controller for controlling said head drive controller and said sub-scanning mechanism to execute printing based on said control parameters when said set resolution is at or beyond a predetermined level.

12. A printing device according to claim 11, wherein said memory furthermore storing second control parameters, including the positions of the pixels that are to be formed during each primary scan, and the feed of the sub-scan set in compliance with conditions under which said raster lines are formed by a plurality of primary scans, conditions allowing the direction of the primary scan during the formation of dots to be aligned during either the forward or return travel for each raster line, and conditions under which raster lines formed during movement in different directions are adjacent to each other; and said printing controller executing printing based on the second control parameters when said resolution is below the predetermined level.

13. A printing device according to claim 11, wherein said resolution setting unit allowing the resolution in the primary scanning direction and the resolution in the sub-scanning direction to be set to different levels; and said printing controller adapting the resolution in the sub-scanning direction to the predetermined levels.

14. A printing device for printing multi-colored images by means of primary scanning, in which a head travels back and forth relative to a printing medium to form raster lines, and sub-scanning, in which said printing medium is conveyed relative to said head in the direction across to said primary scanning direction, so as to form dots for pixels on said printing medium, said head including, in said sub-scanning direction, at intervals of two or more raster lines per color, a plurality of nozzles for discharging ink, wherein said printing device comprises:

memory for storing control parameters, including the positions of the pixels that are to be formed during each primary scan, and the feed of the sub-scan set so that the dots formed in the same primary scanning direction are formed adjacent to each other according to the printing conditions;

printing condition inputter for inputting printing conditions;

head drive controller for driving said head while moving back and forth in said primary scanning to form dots for the pixels specified by the control parameters according to said printing conditions; and sub-scanning mechanism for effecting sub-scanning at a feed specified by the control parameters according to said printing conditions.

15. A printing device according to claim 14, wherein said printing conditions include a resolution during printing, and said control parameters at least set so that the number of dots formed in the same primary scanning direction, which are adjacent to each other in the sub-scanning direction, is a value corresponding to said resolution.

16. A printing device according to claim 14, wherein said printing conditions include the type of images is text images or not, and said control parameters at least set so that dots formed in said same primary scanning direction are aligned with the pixels of the same position in the primary scanning direction, for text images.

17. A printing device according to claim 14, wherein said printing conditions include types of printing media.

18. A method for printing multi-colored images by means of primary scanning, in which a head comprising, in said sub-scanning direction, for each color, a plurality of nozzles for discharging ink, travels back and forth relative to a printing medium to form raster lines, and sub-scanning, in which said printing medium is conveyed relative to said head in the direction across to said primary scanning direction, so as to form dots for the pixels on said printing medium, said printing method comprising the steps of:

(a) driving said head while moving back and forth in said primary scanning to form dots for the pixels; and (b) effecting sub-scanning at a specified feed, wherein steps (a) and (b) are steps carried out based on positions of the pixels that are to be formed during each primary scan, and the feed of the sub-scan set in compliance with conditions allowing the adjacent formation of two or more corresponding dots, in both the primary and sub-scanning directions, during either the forward or return travel of the primary scanning for each ink, within a predetermined multi-tone range.

19. A method for printing multi-colored images by means of primary scanning, in which a head comprising, in said sub-scanning direction, for each color, a plurality of nozzles for discharging ink, travels back and forth relative to a printing medium to form raster lines, and sub-scanning, in which said printing medium is conveyed relative to said head in the direction across to said primary scanning direction, so as to form dots for the pixels on said printing medium, said printing method comprising the steps of:

(a) driving said head while moving back and forth in said primary scanning to form dots for the pixels; and (b) effecting sub-scanning at a specified feed, wherein steps (a) and (b) are steps carried out based on the positions of the pixels that are to be formed during each primary scan, and the feed of the sub-scan preset in compliance with conditions allowing the direction of the primary scanning during the formation of the dots to be aligned during either forward or return travel for each raster line, and conditions under which two or more raster lines formed in each direction of primary scanning are adjacent to each other.

20. A method for printing multi-colored images by means of primary scanning, in which a head comprising, in said sub-scanning direction, for each color, a plurality of nozzles for discharging ink, travels back and forth relative to a printing medium to form raster lines, and sub-scanning, in which said printing medium is conveyed relative to said head in the direction across to said primary scanning direction, so as to form dots for pixels on said printing medium, said printing method comprising the steps of:

(a) inputting printing conditions; and (b) driving said head while moving back and forth in said primary scanning to form dots for the pixels; and (c) effecting sub-scanning at a specified feed, wherein steps (b) and (c) are steps carried out based on positions of the pixels that are to be formed during each primary scan, and the feed of the sub-scan set so that dots formed in the same primary scanning direction are formed adjacent to each other according to the printing conditions.

21. A recording medium on which is recorded a program for operating a printing device for printing multi-colored images by means of primary scanning, in which a head travels back and forth relative to a printing medium to form raster lines, and sub-scanning, in which said printing medium is conveyed relative to said head in the direction across to said primary scanning direction, so as to form dots for pixels on said printing medium, said recording medium having recorded thereon a program comprising data specifying positions of the pixels that are to be formed during each primary scan, and the feed of the sub-scan set in compliance with conditions allowing the adjacent formation of two or more corresponding dots, in both the primary and sub-scanning directions, during either the forward or return travel of the primary scanning for each ink, within a predetermined multi-tone range, and for executing said primary and sub-scanning based on said data.

22. A recording medium on which is recorded a program for operating a printing device for printing multi-colored images by means of primary scanning, in which a head travels back and forth relative to a printing medium to form raster lines, and sub-scanning, in which said printing medium is conveyed relative to said head in the direction across to said primary scanning direction, so as to form dots for pixels on said printing medium, said recording medium having recorded thereon a program comprising data specifying positions of the pixels that are to be formed during each primary scan, and the feed of the sub-scan preset in compliance with conditions allowing the direction of the primary scanning during the formation of the dots to be aligned during either forward or return travel for each raster line, and conditions under which two or more raster lines formed in each direction of primary scanning are adjacent to each other, and for executing said primary and sub-scanning based on said data.

23. A recording medium on which is recorded a program for operating a printing device for printing multi-colored images by means of primary scanning, in which a head travels back and forth relative to a printing medium to form raster lines, and sub-scanning, in which said printing medium is conveyed relative to said head in the direction across to said primary scanning direction, so as to form dots for pixels on said printing medium, said recording medium having recorded thereon a program comprising data specifying as control parameters, including positions of the pixels that are to be formed during each primary scan, and the feed of the sub-scan set so that dots formed in the same primary scanning direction are formed adjacent to each other, for executing the functions of inputting printing conditions and the function of executing said primary and sub-scanning based on control parameters according to the input printing conditions.

* * * * *